US006684531B2

(12) United States Patent
Rennex

(10) Patent No.: US 6,684,531 B2
(45) Date of Patent: Feb. 3, 2004

(54) SPRING SPACE SHOE

(76) Inventor: Brian G. Rennex, 431 Muddy Branch Rd., #101, Gaithersburg, MD (US) 20878

( * ) Notice: Subject to any disclaimer, the term of this patent is extended or adjusted under 35 U.S.C. 154(b) by 75 days.

(21) Appl. No.: 10/026,797

(22) Filed: Dec. 27, 2001

(65) Prior Publication Data

US 2003/0121178 A1 Jul. 3, 2003

(51) Int. Cl.[7] ..... A43B 13/28; A43B 13/14; A43B 1/10; A43B 5/00

(52) U.S. Cl. ..... 36/27; 36/114; 36/102; 36/31

(58) Field of Search ..... 36/27, 28, 58.6, 36/92, 105, 58.5, 69, 80, 72 B, 73, 31, 102, 103, 114, 132, 136; 482/77, 76, 75; 601/29, 34, 33, 28, 27

(56) References Cited

U.S. PATENT DOCUMENTS

| | | | | | |
|---|---|---|---|---|---|
| 1,613,538 | A | * | 1/1927 | Schad | 36/7.8 |
| 3,205,596 | A | * | 9/1965 | Hoffmeister | 36/7.8 |
| 3,557,782 | A | * | 1/1971 | Wafer | 482/75 |
| 4,238,894 | A | * | 12/1980 | Evans | 36/25 R |
| 4,400,894 | A | | 8/1983 | Ehrlich | |
| 4,534,124 | A | | 8/1985 | Schnell | |
| 4,622,764 | A | * | 11/1986 | Boulier | 36/68 |
| 4,936,030 | A | | 6/1990 | Rennex | |
| 5,282,325 | A | | 2/1994 | Beyl | |
| 5,337,492 | A | | 8/1994 | Anderie | |
| 5,384,973 | A | | 1/1995 | Lyden | |
| 5,464,380 | A | * | 11/1995 | Ikeda et al. | 36/81 |
| 5,621,984 | A | | 4/1997 | Hsieh | |
| 5,701,685 | A | | 12/1997 | Pezza | |
| 5,875,569 | A | * | 3/1999 | Dupree | 36/25 R |
| 5,896,679 | A | | 4/1999 | Baldwin | |
| 5,926,975 | A | | 7/1999 | Goodman | |
| 6,079,126 | A | | 6/2000 | Olszewski | |
| 6,105,280 | A | * | 8/2000 | Marcolin | 36/117.1 |
| 6,115,942 | A | * | 9/2000 | Paradis | 36/27 |
| 6,131,309 | A | | 10/2000 | Walsh | |
| 6,149,852 | A | * | 11/2000 | Romanato et al. | 36/14 |

FOREIGN PATENT DOCUMENTS

| | | |
|---|---|---|
| GB | 2179235 | 3/1987 |

* cited by examiner

*Primary Examiner*—Anthony D. Stashick

(57) ABSTRACT

This invention is a spring shoe whose sole is a structure constrained to compress without tilting. This optimally simple, anti-tilt, compressible structure comprises overlapping diamond and parallelogram linkages, which constrain an upper plate from tilting as it moves vertically up and down with respect to a lower plate. Applications include a space shoe with push-off means for natural foot action. Here, a minimal number of springs and stops can be changeably incorporated in the sole to optimi8ze walking and running performance. A heel hugger mechanism ensures that the shoe hugs the heel of the wearer during swing phase. A flex-rigger prevents sideways rollover and sprained ankles. The first shoe embodiment has springs at shoe level to minimize device weight at foot level. The shoe is energy-efficient as it returns maximum impact energy to the runner during thrust at toe-off.

40 Claims, 30 Drawing Sheets

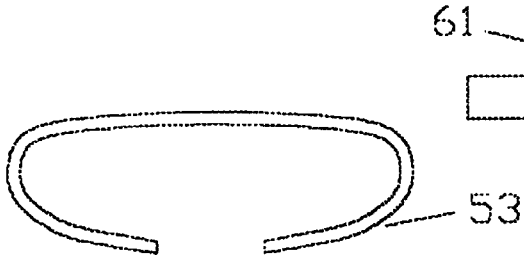
Figure 2d
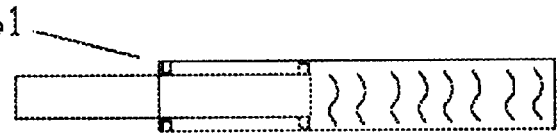
Figure 2e
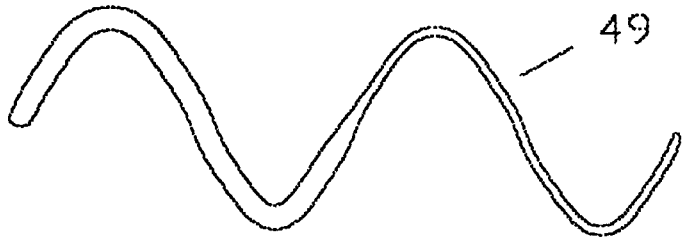
Figure 2c
Figure 2b
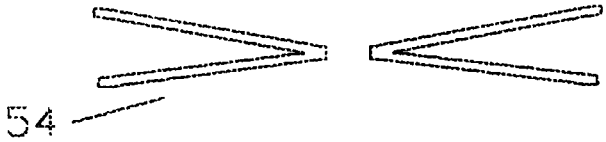
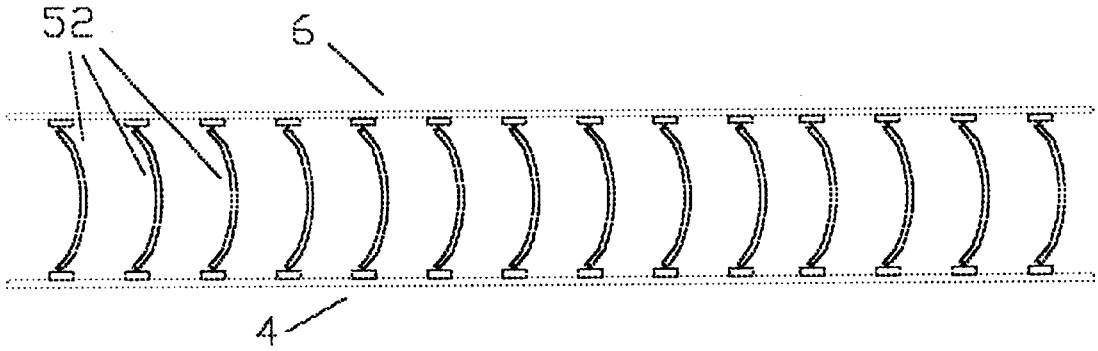
Figure 2a

SPRING SPACE SHOE

BACKGROUND

This invention is a spring shoe called herein a space shoe. Its sole is a structure constrained to compress without tilting; this structure is called herein the p-diamond. This optimally simple, anti-tilt, compressible structure comprises overlapping diamond and parallelogram linkages which constrain an upper plate from tilting as it moves vertically up and down with respect to a lower plate. The p-diamond has many applications where non-tilt spring systems are required, and it is an inexpensive alternative to telescopically guided spring systems. P-diamond applications include, but are not limited to, the space shoe, which also has a push-off means to allow natural foot action.

The first embodiment of the space shoe is called herein a space shoe because most of the skeletal sole is free space rather than a solid, foam-filled structure. The springs of the space shoe act directly between the ground plate and the shoe plate; that is, these springs are located at shoe or sole level. The second embodiment of the invention is called a bow shoe; its bow spring is located at the shin level, or above, to minimize the device weight at foot level.

The space shoe provides for the following improvements (referred to as S1–S3 with "S" for space shoe). (S1) It has an improved mechanism to capture both heel and toe impact energy and return all impact energy through the toe during the latter part of toe-off. (S2) It provides for optimal stability by constraining an upper shoe plate to not tilt with respect to a lower ground plate—via a linkage called herein a p-diamond linkage. Improvement (S2) is referred to herein as sole tilting. Improvement (S3) is that a natural running action is allowed—where this running action comprises both a natural roll-over from heel to toe and a push-off—with the wearer's metatarsal joint freely flexing and the heel lifting into the air during toe-off.

Seven categories of prior shoe art with springs or relevant features are listed below. Examples of each category will be given, along with limitations overcome by the space shoe improvements which improvements will be referred to by the numbers S1 to S3 mentioned above. The first category has multiple springs located throughout the sole or only in the heel. Examples include U.S. Pat. No. 5,621,984 of Hsieh and U.S. Pat. No. 5,337,492 of Anderie. Space-shoe improvements S1, S2, and S3 apply to this category which prior art notably permits sole tilting (S3) and dissipates heel impact energy in mid-stance (S1). With regard to improvement (S1), as the wearer's heel lifts to push-off, the prior-art heel springs release their energy prematurely, the wearer's knee bends and his ankle dorsi-flexes during which time the heel impact energy is largely dissipated. In fact, for this heel impact energy to efficiently propel the wearer up and forward, it must act through the wearer's toe during the latter part of toe-off.

The second category of "springs in soles" prior art has a means to captures all of the heel impact energy for energy return at toe-off. An example is U.S. Pat. No. 4,936,03 of Rennex. Improvements (S2 & S3) apply, and the space-shoe mechanism to achieve improvement (S1) is considerably simpler and cheaper. The third category of "springs in soles" prior art has a linkage to constrain a compressible sole as a spring stores impact energy. Examples include U.S. Pat. No. 4,534,124 of Schnell, U.S. Pat. No. 5,896,679 of Baldwin, U.S. Pat. No. 5,701,685 of Pezza. Space-shoe improvements (S2 and S3) apply to Schnell and Pezza. Improvements (S1, S2, and S3) apply to Baldwin.

A third category of relevant prior art does not actually have springs in the soles. Rather, these patents do provide means for the wearer to flex their metatarsal joint and push off their toe. U.S. Pat. No. 4,400,894 of Erlich, U.S. Pat. No. 5,926,975 of Goodman, and U.S. Pat. No. 5,384,973 of Lyden all feature a narrowing of a conventional, solid sole under the metatarsal joint, and there are many other examples of this solution. U.S. Pat. No. 6,079,126 of Olszewski uses the just-mentioned "narrowing" solution as well as another solution where a conventional, solid sole is split and the upper section lifts with the wearer's heel. A U.S. Pat. No. 5,282,325 of Beyl also teaches a split sole with a torsion spring in the heel.

The current patent also provides for the wearer to flex his metatarsal joint and push off his toe—in a variety of ways. However, the sole structure of the space shoe is distinct—in that it comprises a linkage between plates, instead of the conventional, solid sole of the just-mentioned prior art. That is, even though the "toe-flex" function is the same, the structure and designs of the current patent are quite different and novel, and the general idea of a means for toe-flexing is old in the art.

With reference to the second embodiment of the invention, namely the bow shoe, the above improvements (S1, S2, and S3) still apply—along with some additional improvements labeled "B" for bow shoe. (B1) The bow shoe minimizes weight at the foot for improved energy efficiency. (B2) It uses bow springs to achieve a constant force curve. (B3) It permits optimally few, long, and light bow springs. (B4) It provides for optimal stability by minimizing the unweighted sole thickness.

The fourth category of "springs in soles" prior art has a spring and suspension mechanism in the heel. An example is U.S. Pat. No. 6,115,942 of Paradis with a bow spring. Improvements (S1, S2, B3, and B4) apply to this patent. Another example is U.S. Pat. No. 6,131,309 of Walsh with improvements (S1–S3 and B1, B3 and B4) applicable. The fifth category has a curved ground support hingeably connected in front and in back to the shoe and a single spring in the center. An example is UK Patent # GB2,179,235 of Waldron. Improvements (S1–S3 and B1–B4) apply to this category. The sixth category of has a linkage to constrain a compressible sole as a spring stores impact energy. Examples include U.S. Pat. No. 4,534,124 of Schnell, U.S. Pat. No. 5,896,679 of Baldwin, U.S. Pat. No. 5,701,685 of Pezza. Improvements (S2, S3 and B1–B4) apply to Schnell and Pezza. Improvements (S1–S3 and B1–B4) apply to Baldwin. The seventh and final category uses a linkage to connect the toe of a shoe to the mid-section of a bow spring, the bottom of which contacts the ground. A commercial product of ALANSportartikel, address: GmbH Grafratherstrasse 53, 82288 Kottgeisering/Germany, marketed under the brand name of "Powerskip" and referenced by their website, http://www.powerskip.de, is the only example of this category. Improvement (S3) applies because the force curve is not as constant as for an axially-loaded bow spring, and improvements B3 and B4 apply. The most notable improvement is (B2) because the foot of the wearer of "Powerskip" is a substantial distance above the ground even when the bow spring is fully compressed.

SUMMARY

With reference to the space shoe, in both space shoe and bow-shoe embodiments, the key feature is a compressible sole comprising an eight-bar linkage (called herein a p-diamond sole) which constrains the upper shoe plate not to tilt as it moves vertically up and down with respect to the ground plate. Another feature is a push-off means which allows the wearer to freely push off her toe. Another feature is that a minimal number of springs and stops (even one) of any kind can be used (without need of a spring guide). In one embodiment, the spring system assists heel lift in the latter part of toe-off, thereby reducing the muscle energy expenditure of the calf muscles. These springs and stops can easily be replaced to fit the performance requirements of an individual for walking and running. Another feature is a heel hugger mechanism which ensures that the entire rear section of the space shoe "hugs" the heel of the wears during swing phase. Another feature is a back-flexing outrigger, called herein a "flex-rigger," to prevent sprained ankles; the flex-rigger can be used not only with the space shoes, but also as a retrofit or an integral part of conventional shoes or boots. Another feature is a curved extension extending backward from the bottom of the sole heel; this is called herein a "back-heel." The back-heel minimizes the deceleration of the user's center of mass at heel-strike by reducing the effective angle (backward, off-vertical) of the leg support. The back-heel can also as a retrofit or an integral part of conventional shoes or boots.

The advantages of the space shoe include: the sole can be very thick (2–6 inches) thereby make a wearer taller and enhancing her stride; even when the sole is thick, the wearer's foot rolls over from heel to toe naturally; the wearer pushes off naturally; the shoe is energy-efficient in that it returns maximum impact energy (due to both heel impact and toe impact) to the wearer during thrust at toe-off when it is best utilized; the shoe is light-weight and cheap to manufacture; there are spring systems which provide for a constant force curve, instead of a linear force curve, thereby permitting faster running for a given maximum force, thereby reducing impact injuries; since the surface in contact with the foot is very thin, it is easy to ventilate the foot; this foot-contact can be shaped as a foot orthotic; and the sole thickness (1" to ≦6") and area can easily be changed due to the modular construction.

A critical insight motivating the p-diamond sole is that, in order for heel impact energy to efficiently propel the runner up and forward, it must act through the runner's toe during the latter part of toe-off. The p-diamond sole prevents tilting of the compressible sole, and this constraint causes the heel impact energy to be returned at toe-off. Another performance enhancement in terms of energy efficiency results from the fact that the p-diamond sole can be made very thick. This allows the wearer to minimize knee flexion in both walking and running.

With reference to the bow-shoe embodiment only, one key feature is a bow spring to achieve a constant spring force curve which doubles the potential energy storage in a sole of a given thickness. Another key feature is a suspension system in which a bow spring is loaded by full foot impact—both by the heel and the toe. This suspension system permits the location the bow spring above the foot at the shin or thigh level to minimize the device weight at foot level—thereby improving energy efficiency. Also, the use of an 8-link system allows the sole components to be optimally light. Another improvement is related to the constant force curve, referred to as a buckling curve, achievable with bow springs. This allows a safe threshold force level to be set, and twice as much energy call be stored for a given sole thickness as with a linear spring. Also, bow springs can be more than 90% energy efficient. A consequence of the anti-tilt feature inherent in the p-diamond sole is that a spring located anywhere in the sole resists sole compression at both the toe section and the heel section. This means that one or two springs or stops suffice, and modular design makes it a simple matter to change springs to tune the bow shoe to an individual's weight and gait and to change shoe and ground plates for different size feet. Another improvement is that the bow shoe provides for optimal stability by minimizing the unweighted sole thickness—by virtue of the remote location of the bow spring above the foot level. That is, since the bow springs are not located in the sole, the sole can be fully compressed. Finally, the p-diamond sole can be manufactured very cheaply.

Other applications of the main invention, the p-diamond include 1) a spring/foot component of a walking/running brace or of a backpack-supporting brace for walking and running and 2) "one degree of motion" actuators for prostheses or for robotics.

BRIEF DESCRIPTION OF THE DRAWINGS

FIG. 2 is a schematic side view of the space shoe showing various vertical and lengthwise springs located within the sole.

DETAILED DESCRIPTION OF THE INVENTION

Figure 1C:
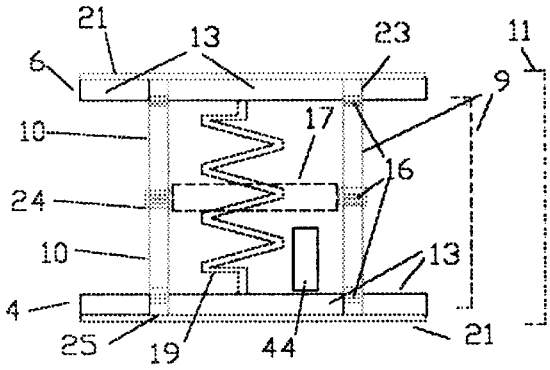
FIG. 1 shows views of the main invention, a non-tilting compressible structure called p-diamond.

FIG. 1 shows views of the main invention, a non-tilting compressible structure called p-diamond 11. Side-view FIGS. 1*a* and 1*b* show p-diamond 11 expanded and compressed. FIG. 1*c* is a front view and FIG. 1*d* is a top view. P-diamond 11 comprises one or more (two here) p-diamond linkages 9, rigidly connected by cross beams 13, and optionally covered by cover plates 21 on the top and the bottom. P-diamond linkage 9 comprises four diamond links 10, one top length link 23, one center length link 24, one bottom length link 25, and two end links 14—all of which are hingeably connected in the depicted configuration by link hinges 16. Top length link 23 and bottom length 25 optionally extend beyond link hinges 16 on either end, but the functional parts for p-diamond linkage 9, that causes the critical motion constraint of p-diamond linkage 9 to move with only one degree of freedom, requires only the parts between the link hinges 16. In total, these links form an 8-bar linkage which constrains upper frame 6 to move vertically (with no tilting) with respect to lower frame 4. In this embodiment, upper frame 6 comprises two top length links 23, cross beams 13 at the top, and cover plate 21 at the top. Likewise, lower frame 4 comprises two bottom length links 25, cross beams 1 3 at the bottom, and cover plate 21 at the bottom.

Figure 1D:
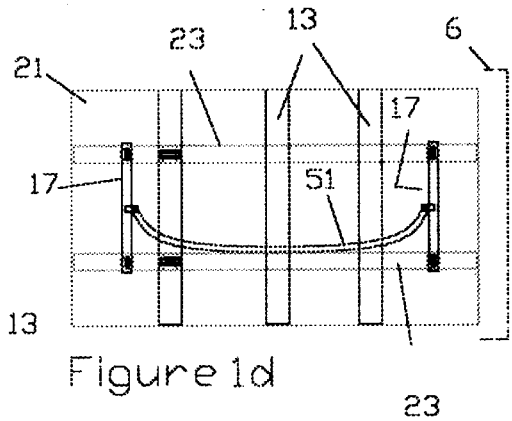
Figure 1B:
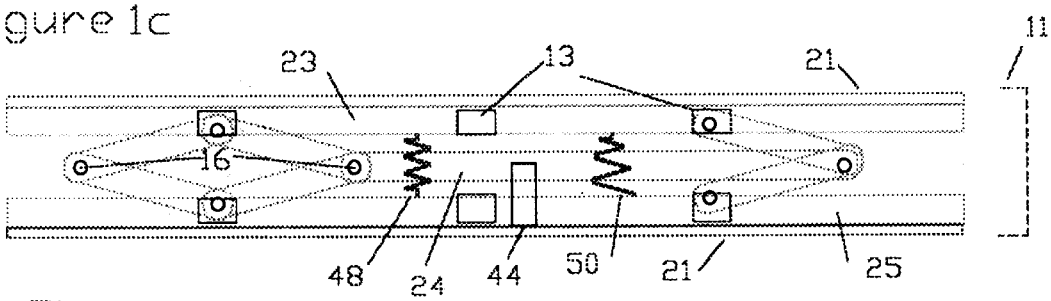
Figure 1A:
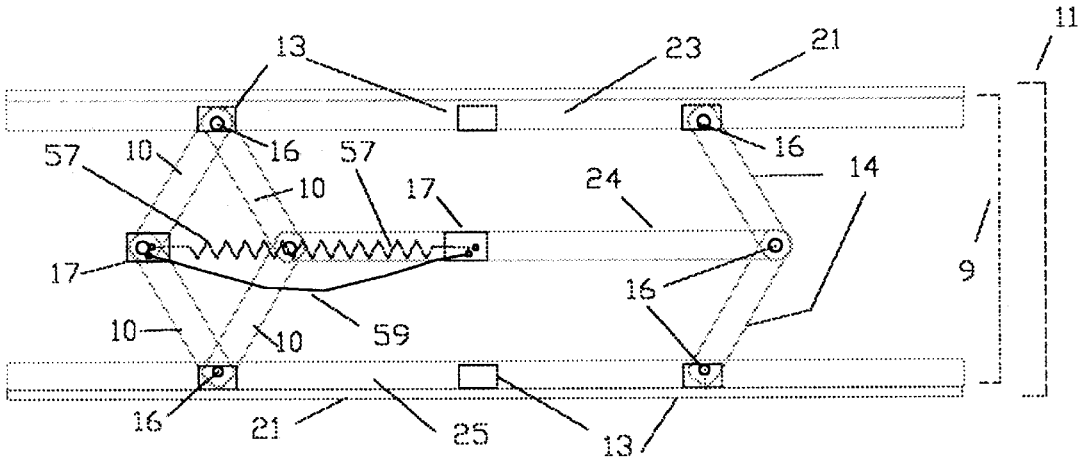

FIG. 1*a* shows lengthwise spring 57 which resists any compression force on p-diamond 11; vertical springs 19 also resist external compression. An external compression force can be exerted at any point on and between the areas of upper frame 6 and lower frame 4. At the same time an expansion force can be exerted at any point on and between the areas of upper frame 6 and lower frame 4. Even though the compressive and expansive forces are not located in the same place, upper frame 6 will not tilt with respect to lower frame 4. This is the key feature of the p-diamond invention. The term "p-diamond" refers to the fact that the linkage comprises overlapping parallelograms and diamonds. The value of the invention is that this is the simplest structure using only hinges to achieve this particular constraint of one degree of motion, and hinges are the cheapest, lightest, most robust means to achieve guiding of spring mechanisms in many applications.

FIG. 1 actually depicts several variations of spring systems. FIG. 1*a* shows lengthwise spring 57 (helical) acting between 1) the center cross bar 17 located at the cross beam at link hinge 16 connecting the outside (left) pair of diamond links 10 and 2) the center cross bar 17 between adjacent center length links 24. Note ths this second location could be anywhere along center length links 24. Diamond tether 59 limits the amount of compression. FIG. 1*b* shows the alternative of a generic vertical spring 19 resisting compression and stop 44 limiting compression. These can be helical springs 48 or spiral helical springs 50 (which can compress to the wire thickness).

FIG. 1*c*, the front view, shows the locations of vertical spring 19 and stop 44, located in this case between the adjacent p-diamond linkages 9. In dashed lines, the location of center cross bar 17 is shown—for when a lengthwise spring 57 is used. Top view FIG. 1*d* shows a pre-bent bow 51 acting (in tension to resist compression) between two center cross bars 17. Also shown here is how cover plate 21 covers the frame work comprising top length link 23 and cross beams 13. Cover plate 21 is optional and upper frame 6 or lower frame 4 could alternatively be anything from a simple plate to a molded and highly optimized covered, pocketed framework.

FIG. 2 is a schematic side view of the space shoe showing various vertical and lengthwise springs located within the sole. Vertical spring options include one or more bow springs 52 (FIG. 2*a*) or leaf springs 54 (FIG. 2*b*). Since p-diamond sole 8 guides upper frame 6 to not tilt or move sideways with respect to lower frame 4, a minimal numbers or vertical springs, even one, can be used, and the both the heel and toe impact energy are returned through the wearer's toe during the latter part of toe-off. Notably, single or multiple springs and stops of any shape can be used to achieve any desired travel or compression from very little to the entire thickness of the unweighted sole. This full thickness may be only an inch or it may be six inches or more.

Examples of the lengthwise springs 57 shown in FIG. 1 include optionally tapered serpentine spring 49 in FIG. 2*c*, pre-bent-back spring 53 in FIG. 2*d*, and air spring 61 in FIG. 2*e*. By tapering serpentine spring 49 in a particular manner, it is possible to get just the right "hard" force curve where hard means the curve increases faster than a linear spring. Only a single bend or multiple bends can be used in serpentine spring 49. Pre-bent-back spring 53 has a soft curve, while air spring 61 has a hard curve.

Figure 3:
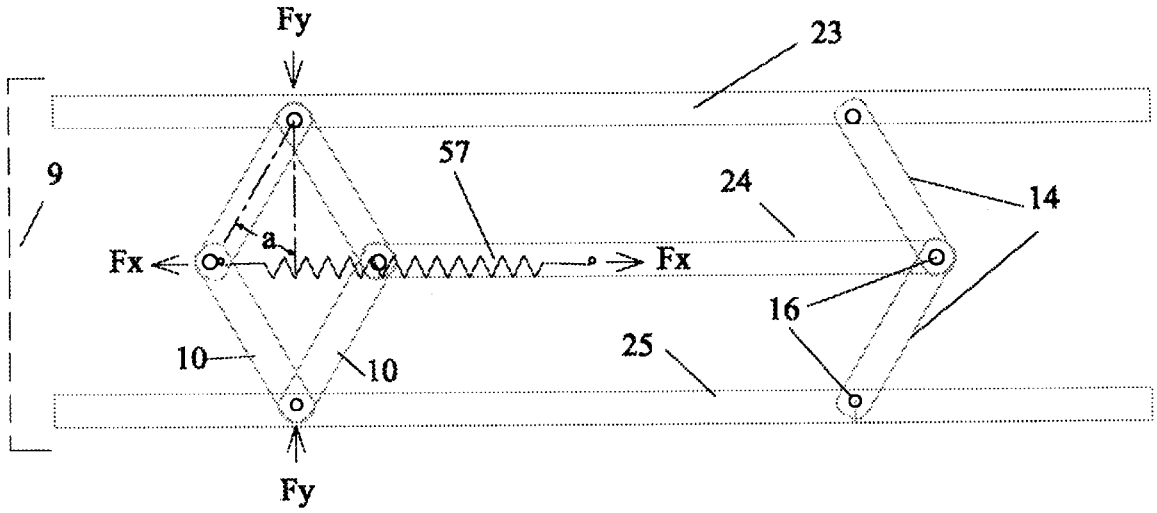
FIG. 3 shows a side view of a p-diamond linkage indicating how lengthwise springs with the proper hard force curve can be used to achieve a constant force curve.

FIG. 3 shows a side view of a p-diamond linkage indicating how lengthwise springs with the proper hard force curve can be used to achieve a constant force curve. The vertical force exerted by lengthwise spring 57 can be expressed as the product of the mechanical advantage, MA, due to the diamond structure, times the horizontal force, Fx, exerted by lengthwise spring 57. If the length of diamond link 10 is Ld and the spring rate is K, then $Fy=MA*K*x$ where x is the change in length of lengthwise spring 57 as each diamond link 10 rotates an angle, a, from vertical—assuming a linear spring. Also, $MA=(\cos(a)/\sin(a))$ and $x=Ld*\sin(a)$. Thus, $Fy=Ld*K*\cos(a)$. By using a tension spring proportional to $(1/\cos(a))$, one can achieve a constant force curve in which Fy remains approximately constant as p-diamond 9 compresses under a load. Proper construction of a tapered pre-bent bow 51 (FIG. 1*d*) or serpentine spring 49 (FIG. 2) will provide a hard curve which can be designed to give the desired force curve.

Figure 4B:
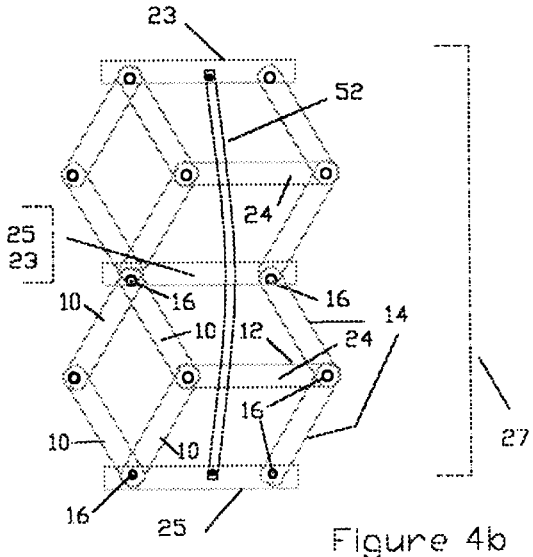
FIG. 4 shows side views of mirrored and vertically stacked configurations of p-diamonds.
Figure 4A:
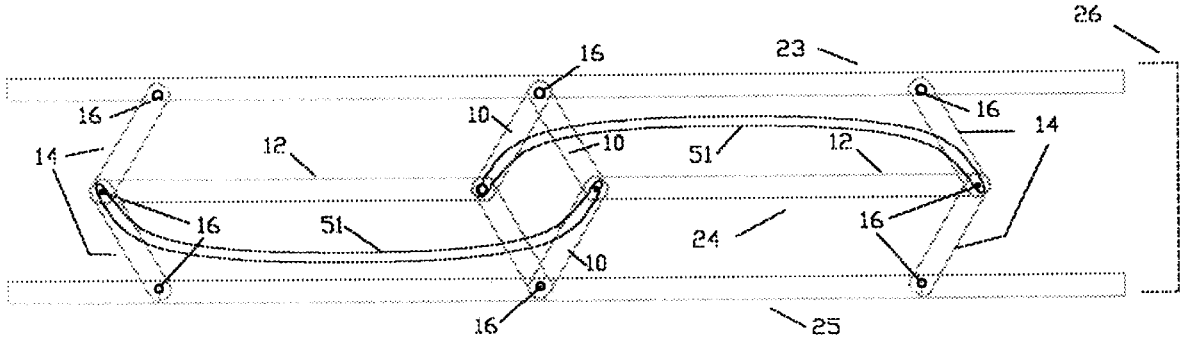

FIG. 4 shows side views of mirrored and vertically stacked configurations of p-diamonds. In FIG. 4*a,* mirrored p-diamond 26 comprises two mirrored p-diamonds which share both diamond links 10 and top, center and bottom links length links 23, 24, and 25. In FIG. 4*b,* vertically stacked p-diamond 27 basically has an upper p-diamond linkage 9 which shares its bottom length link 25 with the top length link 23 of the p-diamond linkage below it. Here, a single bow spring 52 can be guided and compressed by vertically stacked p-diamond 27. Two or more stages (stacked units) could be used with vertically stacked p-diamond 27.

Figure 5C:
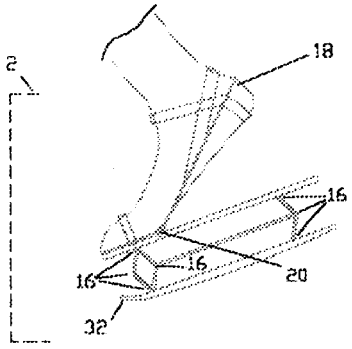
FIG. 5 is a schematic side view of the space shoe showing the compressible p-diamond sole.
Figure 5B:
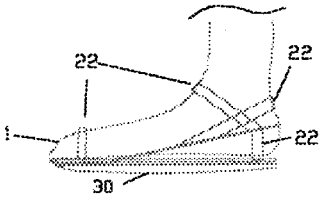
Figure 5A:
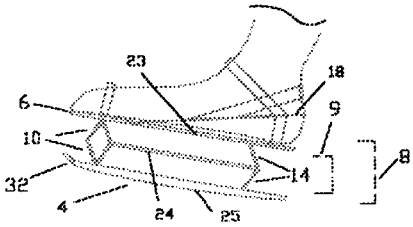

The primary application of the p-diamond invention is space shoe 2 which is the first embodiment of the space shoe. All space shoe embodiments use p-diamond 11 of FIG. 1 and all of the features and benefits of this structure discussed above apply. That is, the basic components and functions of the p-diamond are the same. The spring system is not shown in FIG. 5. FIG. 5 is a schematic side view and FIG. 6*a* schematic front view of the first embodiment of a space shoe. FIG. 5*a* shows heel-strike, FIG. 5*b* shows mid-stance with p-diamond sole 8 compressed, and FIG. 5*c* shows toe-off. Wearer's foot 1 is confined to the front section of upper frame 6 and to push-off frame 18 by shoe straps 22.

Push-off frame 18 is one example of a push-off means, which achieves the following functions. (1) It always allows the wearer to flex her metatarsal joint to lift her heel and push off her toe at toe off. (2) It optionally may prevent the wearer's toe from twisting out of the foot attachment means at the toe section by constraining the rear part of the wearer's foot to lift vertically with respect to the rear part of upper frame 6. (3) It optionally may lift the rear part of upper frame 6 to contact the wearer's heel during swing phase. Push-off frame 18 may extend around the wearer's heel a variable distance above the bottom of the heel or it may extend only part way back toward the heel. It may also be a plate located at the bottom of the wearer's heel and mid-foot, which plate may be have holes or voids of variable size. Several examples of push-off means will be give in the discussion of FIGS. 17 and 18

Figure 6:
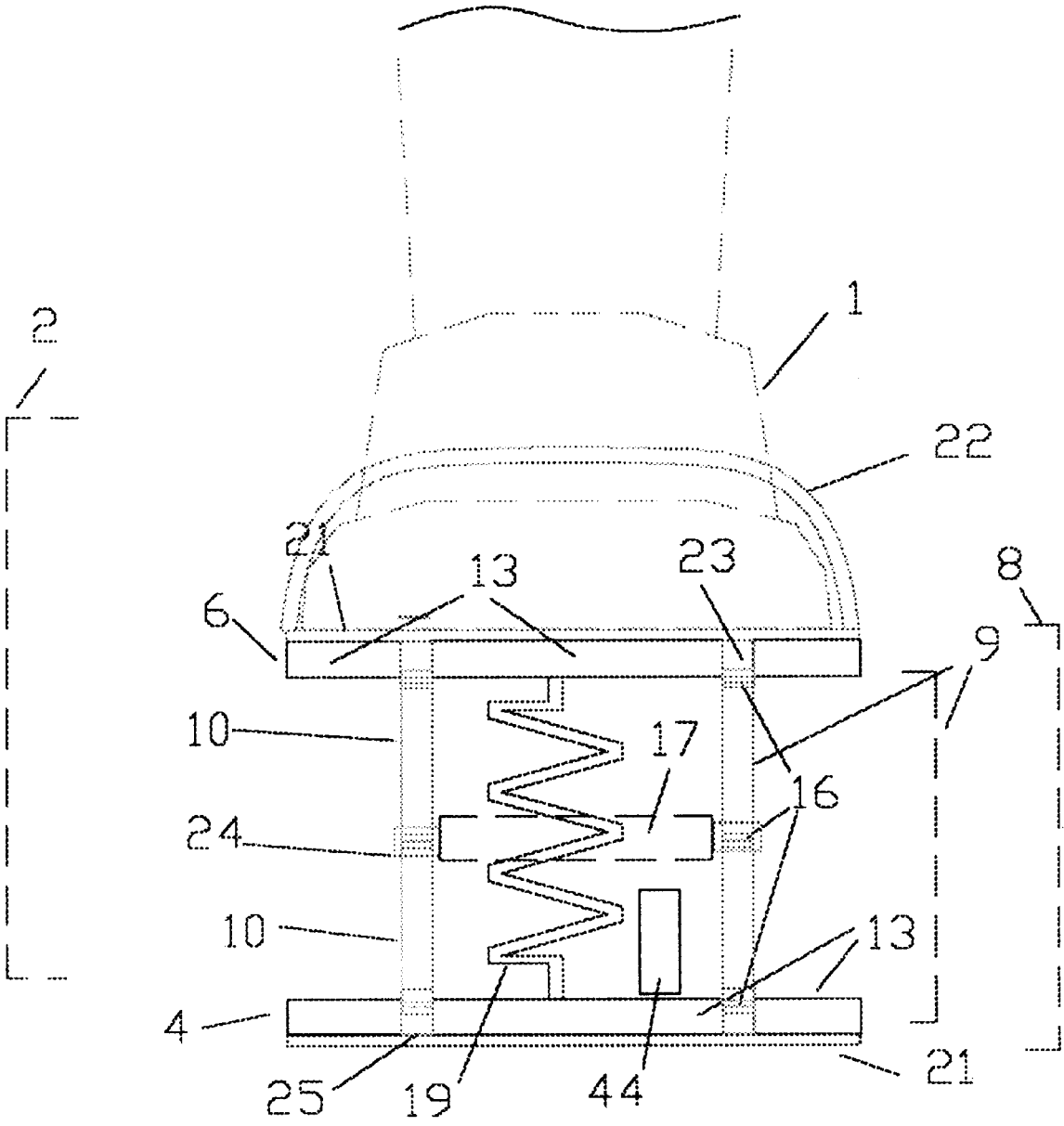
FIG. 6 is a schematic front view of the space shoe showing the compressible p-diamond sole.

FIG. 6 shows the front view of p-diamond sole 8, and it is entirely equivalent to FIG. 1*c* except that the runner's foot 1 is now attached to cover plate 21 by shoe straps 22. P-diamond sole 8 corresponds to p-diamond 11 in FIG. 1, comprising the same linkage elements. Here, vertical spring 19 and stop 44 are shown. Optional push-off frame 18 is pivotally connected to upper frame 6 below or on the outsides of the location of the metatarsal joint of wearer's foot 1—thereby allowing the wearer to push off naturally at toe-off. Lower frame 4 may incorporate ground plate rocker 30 (shown in place of bottom length link 25 in FIG. 5*b*) and ground plate curved toe 32 to optimize the energy return of space shoe 2 (by permitting greater forward tilt at toe-off). Also, cover plate 21 need not cover the entire area of lower frame 4; it could simply be a durable material such as vibram or hard rubber bonded to the length and cross beam elements of lower frame 4.

Figure 7B:
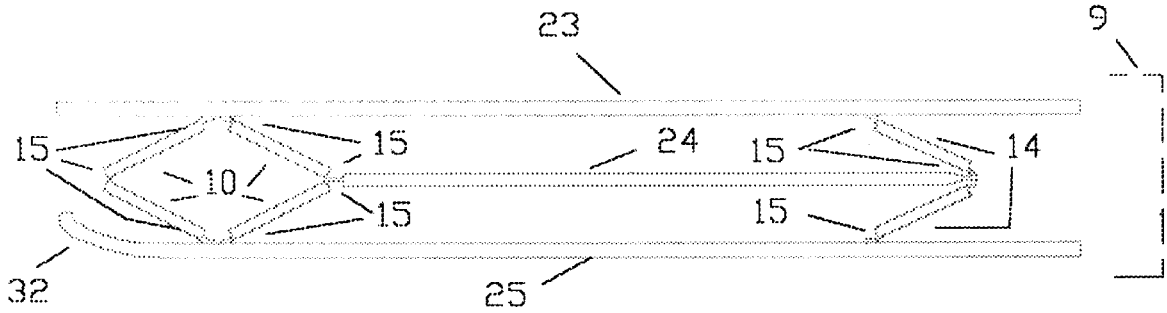
FIG. 7 is a schematic side view of the p-diamond sole with necked link hinges.
Figure 7A:
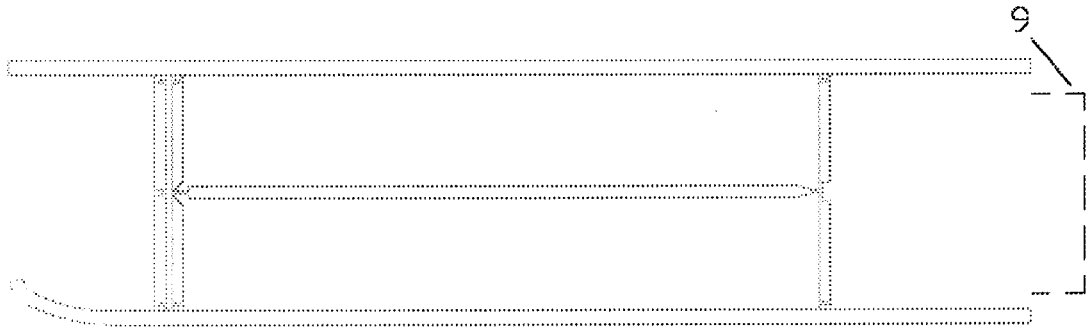
Figure 8C:
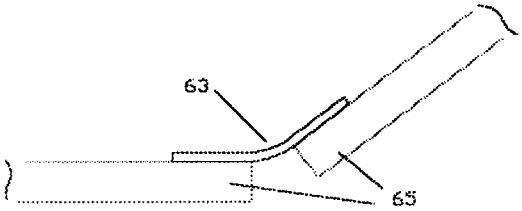
FIG. 8 is a schematic side view of examples of necked link hinges.
Figure 8D:
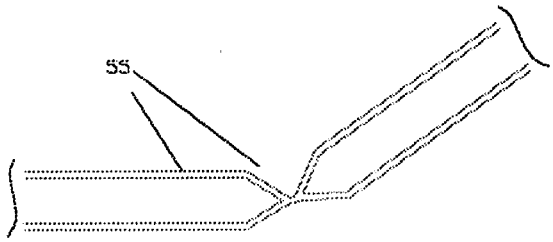
Figure 8B:
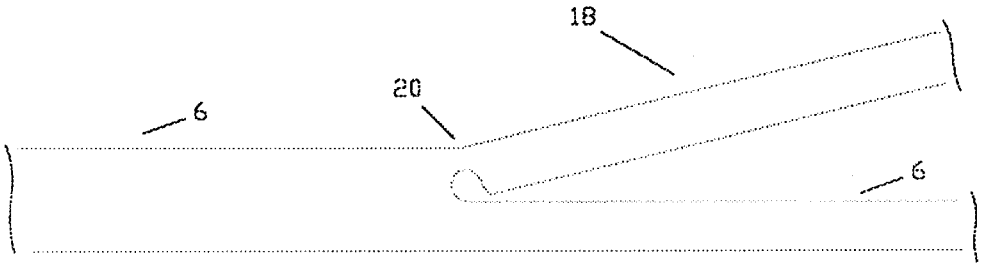
Figure 8A:
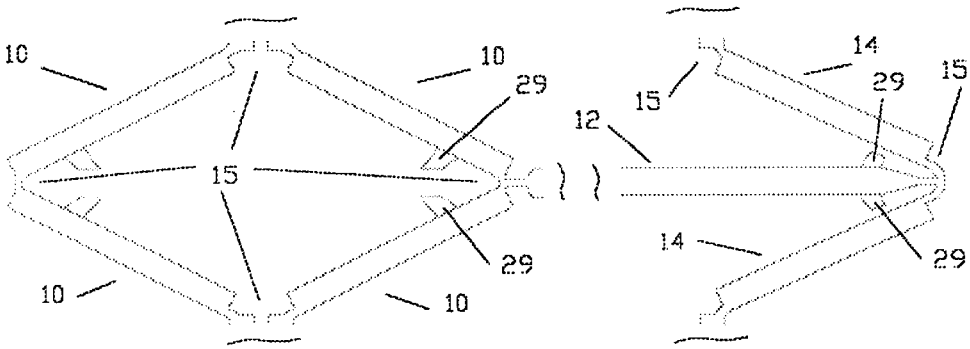

FIG. 7 shows schematic side views of a p-diamond linkage 9 using necked pivots. FIG. 7*a* shows p-diamond sole 8 fully expanded, and FIG. 7*b* shows p-diamond sole 8 with p-diamond linkage 9 partially compressed. FIG. 8*a* shows a blow-up of the diamond 4-bar linkage made up of the four diamond links 10 which are interconnected by necked link hinges 15, which flex easily by virtue of having a small cross section and by virtue of being made of a compliant material. Necked-pivot stops 29 can also be used to limit compression. Necked pivots 15 for rear links 14 and toe hinge 20 are also shown in FIG. 8*b*. Notably, p-diamond sole 8 can be cheaply and easily fabricated by stamp cutting out of a sheet or by using mold technology. FIG. 8*c* shows another method for a "necked-down" hinge comprising elastic strip 63 bonded to link beam 65; or, in FIG. 8*d,* necked tube (which might have a square cross section) is another possibility. The flexible material might be fiber composites or nickel-titanium alloys (Nitinol) known to have high duty cycles for flexing.

Figure 9A:
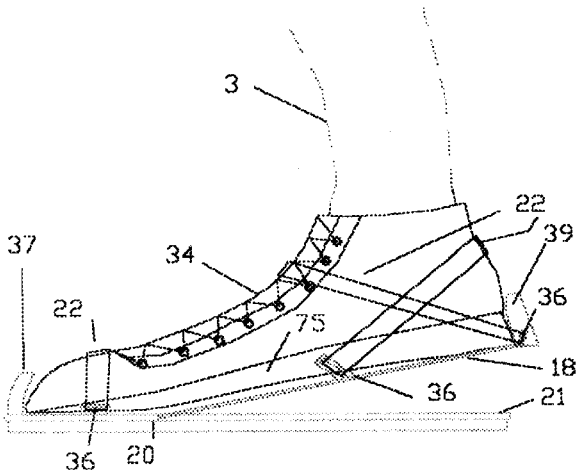
FIG. 9 shows means to attach a foot to the space shoe.
Figure 9B:
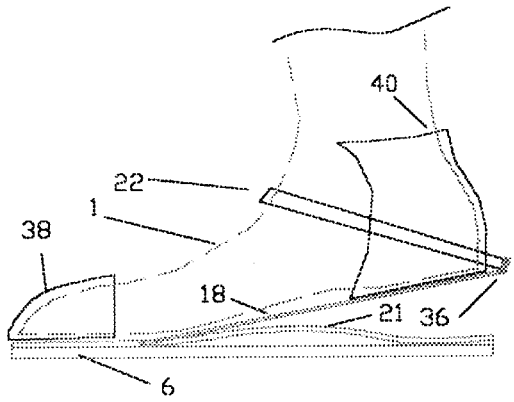

FIG. 9 shows means to attach a foot to the space shoe. FIG. 9*a* shows one of many possible strapping arrangements to for shoe straps 22 to attach pre-existing shoe 34 to the front section of upper frame 6 and to the rear section of push-off frame 18 via buckles 36. FIG. 9*b* shows toe cup 38 and heel cup 40 which can be used with or without a pre-existing shoe for the same attachment and which may incorporate further shoe straps 22. Heel bumper 39 and toe bumper 37 can also be optionally used to confine pre-existing shoe 34 to the space shoe. The rest of the sole of the space shoe is not shown here. In this instance, push-off frame 18 is located at the level of the bottom of pre-existing shoe 34 or wearer's foot 1, and it may extend a variable distance underneath pre-existing shoe 34 or wearer's foot 1. Also, plate cover 21 here is shaped like an orthotic to conform to and give arch support to the bottom of runner's foot 1. Plate cover 21 could optionally be perforated to improve foot ventilation.

Figure 10:
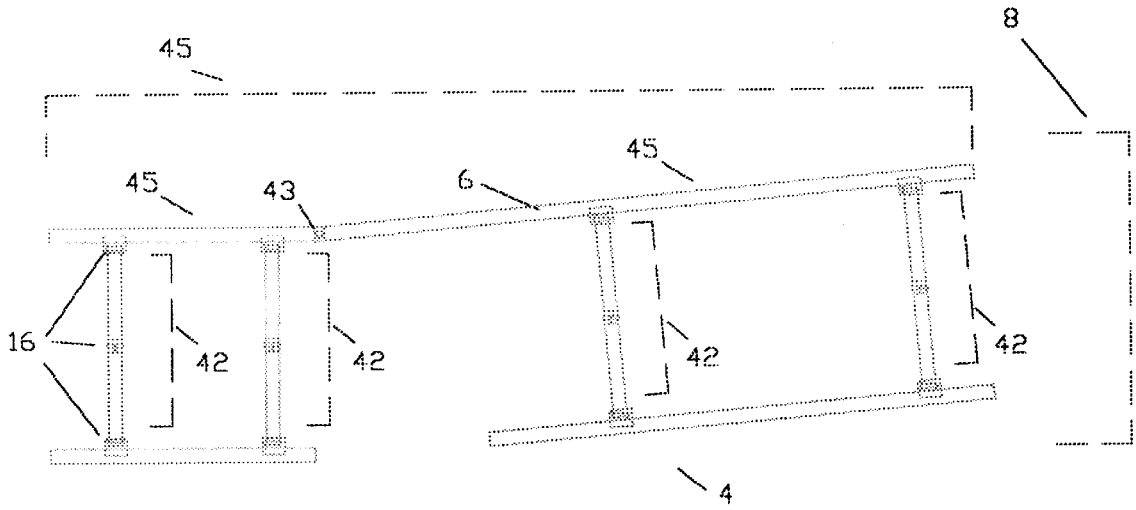
FIG. 10 is a schematic side view of the space shoe showing transverse orientation of multiple p-diamond linkages.

FIG. 10 is a schematic side view of p-diamond sole 8 showing transverse orientation of multiple p-diamond linkages 42 which now flex in the transverse direction as p-diamond sole 8 compresses. In this case it is possible to use shoe plate hinge 43 to allow push-off as hinged shoe plate 45 folds. Also, there is a gap in lower frame 4. Or, push-frame 18 of FIG. 5 could be used instead of plate hinge 43. Springs and stops or tethers could also be incorporated here.

Figure 11A:
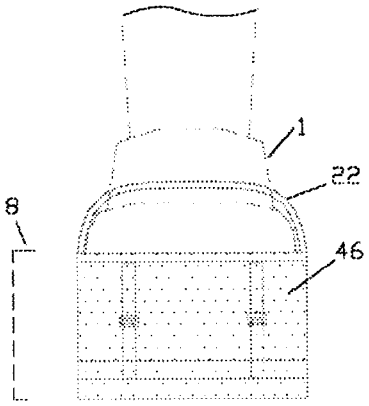
FIG. 11 is a schematic side view of the space shoe showing elastic walls.
Figure 11B:
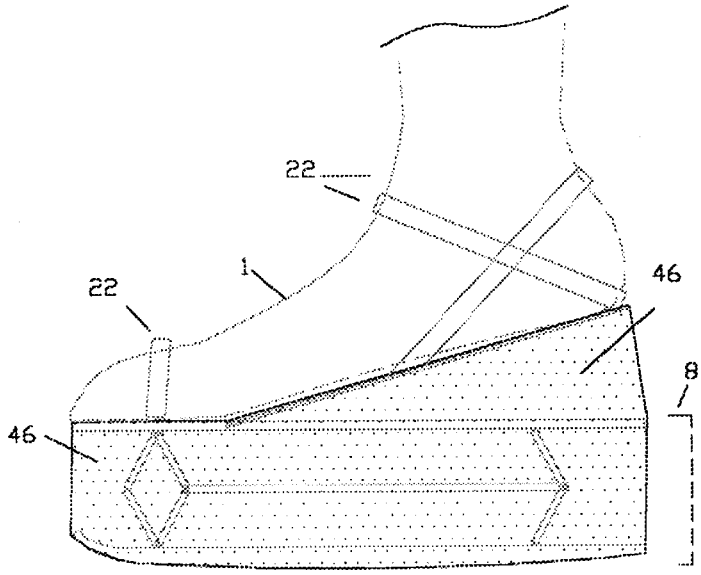

FIG. 11 is a schematic side view of the space shoe showing elastic walls 46. These are attached to and surround p-diamond sole 8, and they may be sufficiently elastic not to wrinkle even when p-diamond sole 8 is fully compressed. These could be elastic or transparent. And, they could be used to keep dirt out of p-diamond sole 8 or to make a fashion statement.

Figure 12:
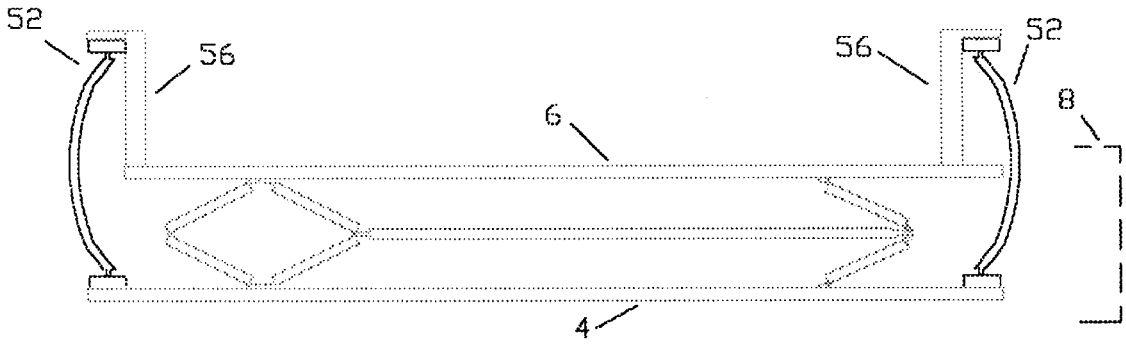
FIG. 12 is a schematic side view of the space shoe showing springs extending above the sole.

FIG. 12 is a schematic side view of the space shoe showing bow springs 52 extending from lower frame 4 above p-diamond sole 52 to support upper frame 6 via shoe-plate posts 56. Other springs such as helical springs could be used instead. The advantage of these "external" springs which are not restricted to lie within the shoe sole is that the sole thickness can be smaller, and the springs, especially the bow springs, can be better optimized. Also, these external springs may be located anywhere on the outside perimeter of lower frame 4 including: only on the outside, in the front and the back, or only in the front. The structural constraint of the p-diamond linkage ensures that a spring located anywhere in the sole, e.g., only in the front, is loaded by a force acting anywhere on the sole, e.g., in the back.

Figure 13B:
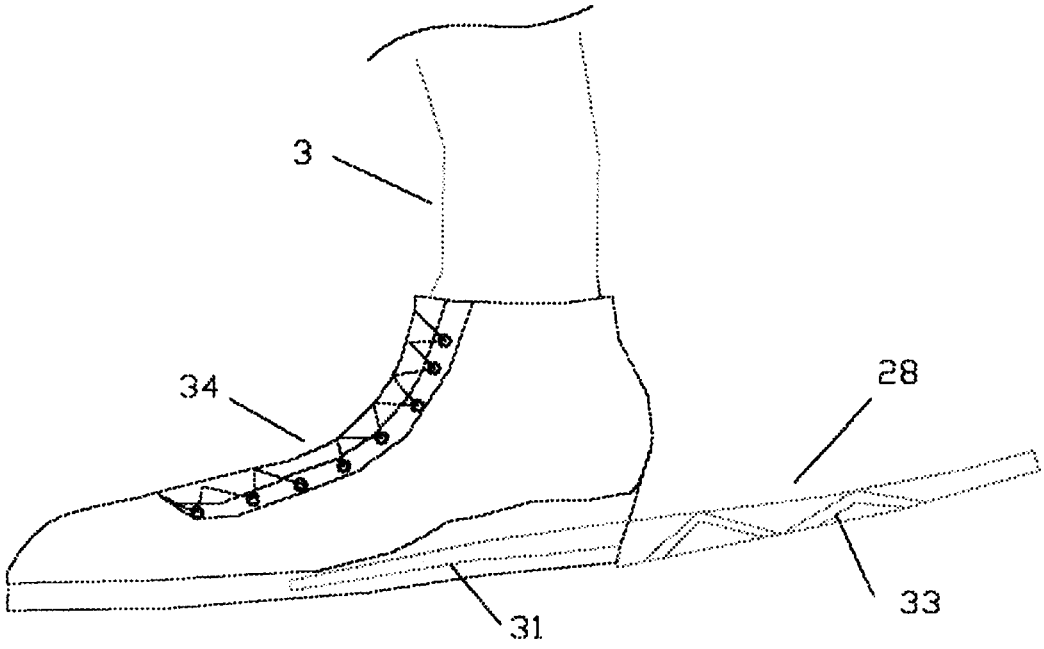
FIG. 13 is a schematic side view of the space shoe showing an elevated heel on the push-off frame and a back heel.
Figure 13A:
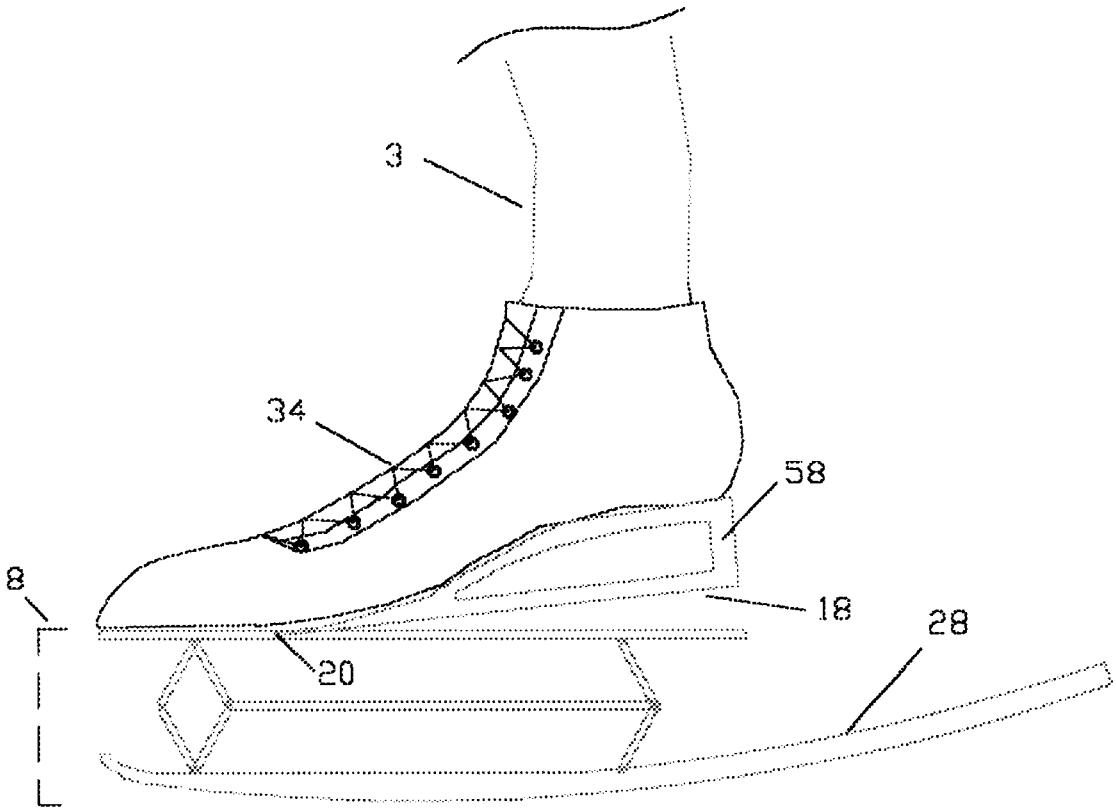

FIG. 13 is a side view of the space shoe showing elevated heel 58 which is now an integral part of push-off frame 18, and showing back-heel 28. This elevated variation is a basis for high heels or elevator shoes. The improvement here is that push-off is allowed due to push-off frame 18 and due to the fact that a substantial part of the increase in height of the wearer of this space shoe is due to the thickness of p-diamond sole 8. Thus, the height of elevated heel does not need to be as large to make a person significantly taller. Another advantage is that this space shoe is much more comfortable, e.g. than a high heel, since there is ample arch support, and the wearer's weight is distributed over the entire foot. The heel elevation can also be realized by building up the heel part of upper frame 6, or it can be realized by building up both a push-off frame (18) and upper frame 6. Back-heel 28 has a circular shape with a radius equal to the length of the runner's leg. Its purpose is to reduce the angle back away from vertical at which the effective leg force acts (defined by the line between the runner's center of mass and the point of contact between back-heel 28 and the ground)—thereby reducing the deceleration of the runner's center of mass during heel strike. FIG. 13*b* shows how pre-existing shoe 34 can incorporate back-heel 28 via sole shank 31. Also, back heel 28 can be structurally enhanced with back-heel structural reinforcements 33. Another possibility is to retrofit conventional shoes with back-heels 28.

Figure 14B:
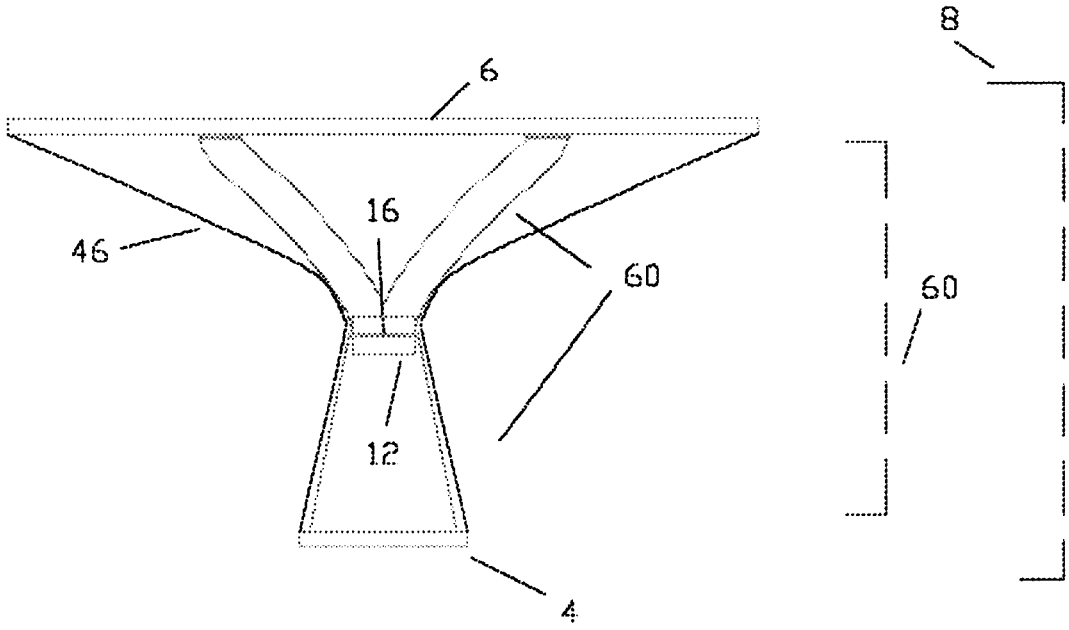
FIG. 14 is a schematic front view of the space shoe showing various profiles for the p-diamond sole.
Figure 14A:
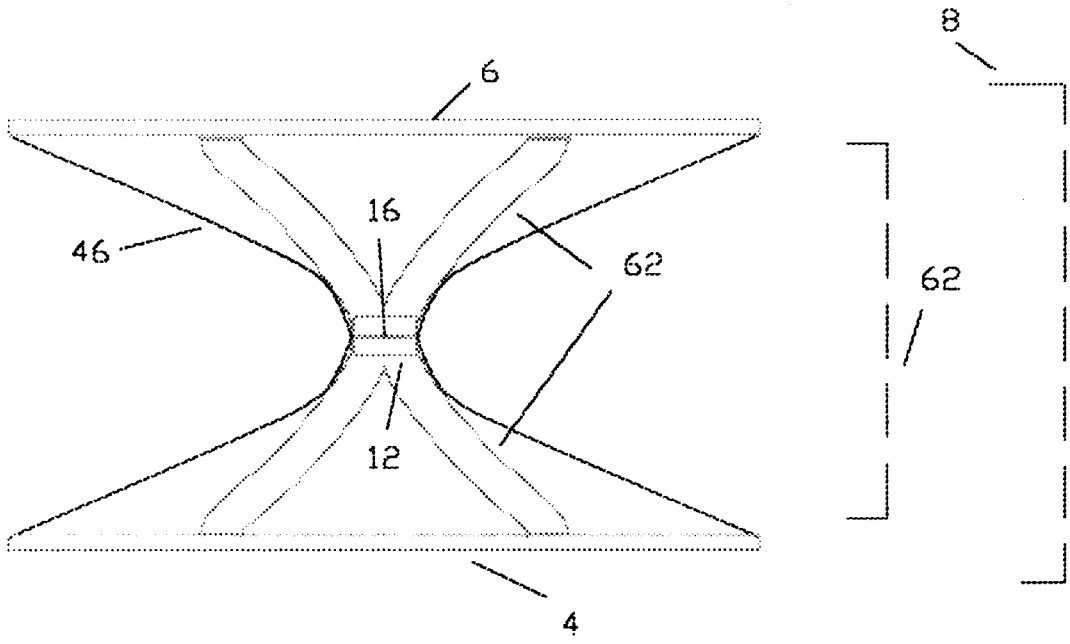

FIG. 14 is a schematic front view of the space shoe showing various profiles for p-diamond sole 8. FIG. 14*a* shows hourglass linkage 62, and FIG. 14*b* shows pedestal linkage 60. The purpose of these variations is to make a more attractive style which lends itself to use with high heels. Elastic walls 46 also improve the appearance of the shoe.

Figure 15B:
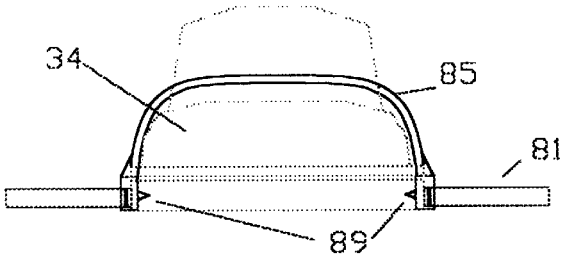
FIG. 15 is a schematic front view of the space shoe showing back-flexing outriggers to prevent sprained ankles.
Figure 15C:
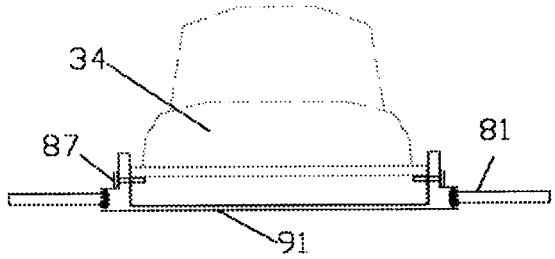
Figure 15A:
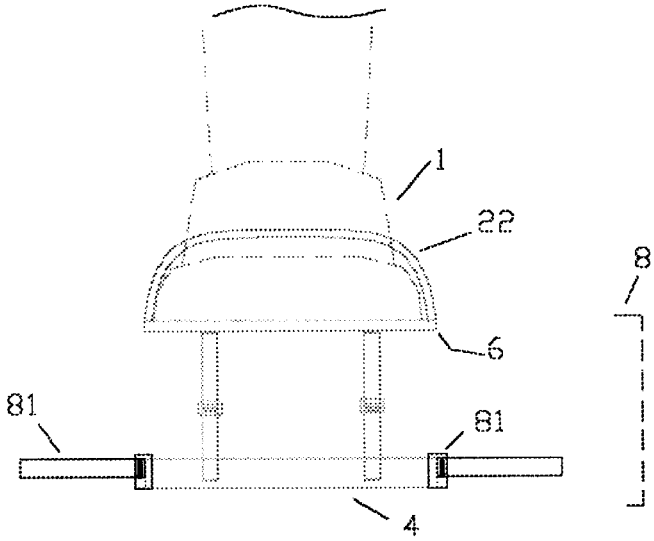
Figure 16:
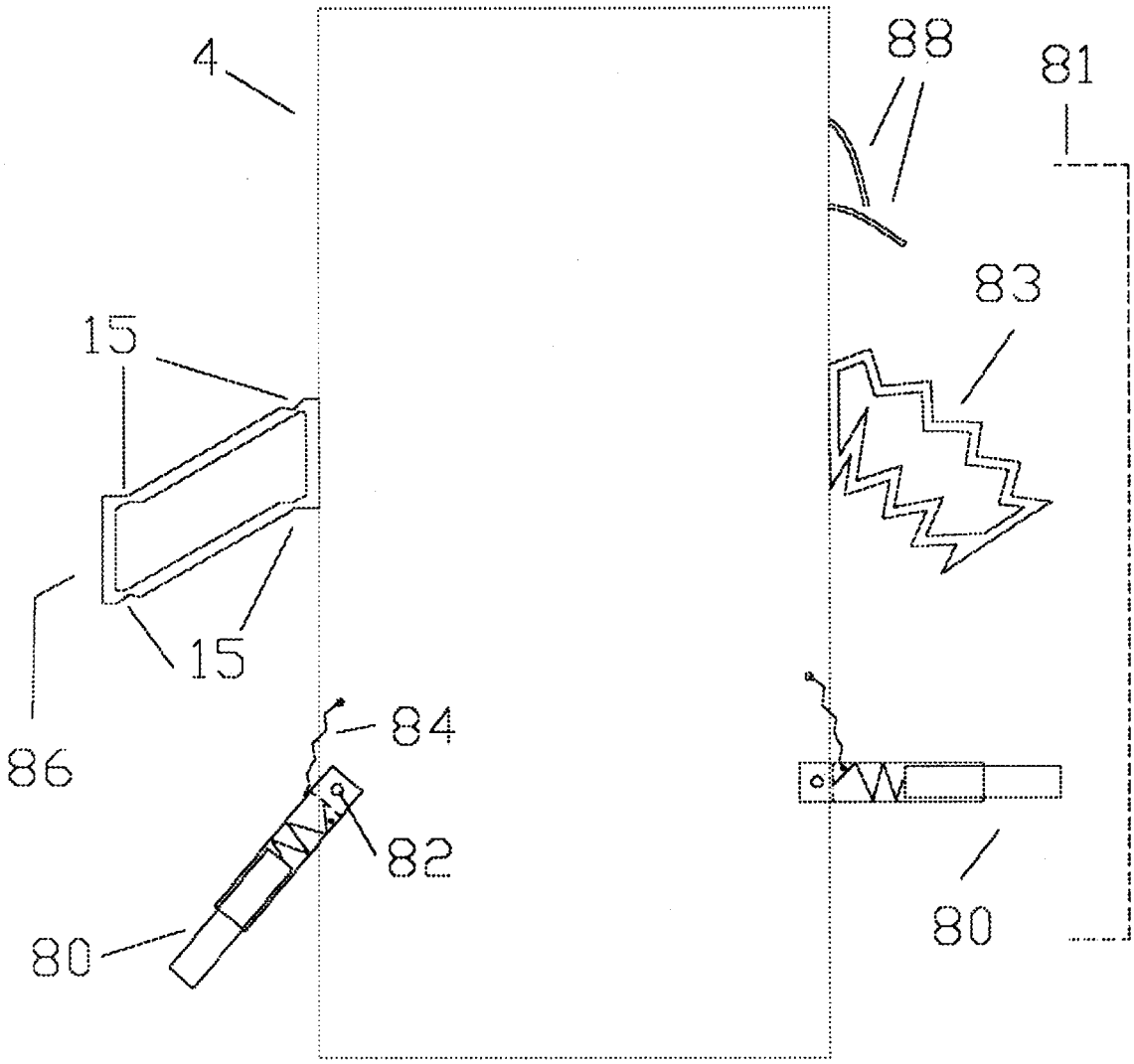
FIG. 16 is a schematic top view of the space shoe showing various back-flexing outriggers to prevent sprained ankles.

FIG. 15*a* is a schematic side view and FIG. 16*a* schematic front view of the space shoe showing back-flexing outriggers called flex-riggers 81 to prevent sprained ankles. These flex-riggers 81 all are stiff to prevent rotating upwards, but they flex backward easily to prevent the wearer from tripping. For example, hinged flex-rigger plungers 80 are hingeably connected to lower frame 4 so that they can be swept back easily if they hit the other foot or an impediment on the ground. However, they resist "roll" rotation of lower frame 4 about a front-back axis, and, hence, they prevent twisting of the wearer's ankle. That is, they flex easily back and forward, but not up and down. Flex-rigger spring 84 weakly biases outrigger 80 to stick out to the side. Another feature, as demonstrated by the plunger feature in hinged flex-rigger plunger 80, is that a flex-rigger can be designed to give when pushed directly inward from the side, so as to not damage an object or a person next to the user. Other means such as pleated frame 83 could also be used to give in toward the shoe as well as backward and forward—but not up since the top and bottom sides would not be pleated. Flex-rigger wands 88 are also shown can also be used. Necked flex-rigger frames 86 with necked link hinges 15 can be used provided their depth is large enough to prevent up/down motion. Necked link hinges 15 permit front/back motion. These flex-riggers 81 can be used just as well with conventional shoes in which case they are attached to the shoe sole. They could either be incorporated in the sole as manufactured, or they could be fixably attached to retrofit the sole of a pre-existing shoe. The methods of attachment of flex-rigger 81 to lower frame 4 (or to shoe sole 75 of pre-existing shoe 34 in FIG. 9) would include, but not be limited to, bonding, riveting, or screwing.

In addition, flex-rigger 81 could manufactured as an integral part of the soles for new types of conventional shoes or for lower frame 4. For retrofitting, FIG. 15*b* shows a front view of a shoe retrofit design with top bar 85 rigidly attached to flex-rigger 81, for structural, anti-tilting strength, and using snap pins 89 to snap onto pre-existing shoe 85. FIG. 15*c* shows another retrofit design using under bands 91 which keep flex-rigger 81 tight on pre-existing shoe 34, along with sole screws 87.

Figure 17:
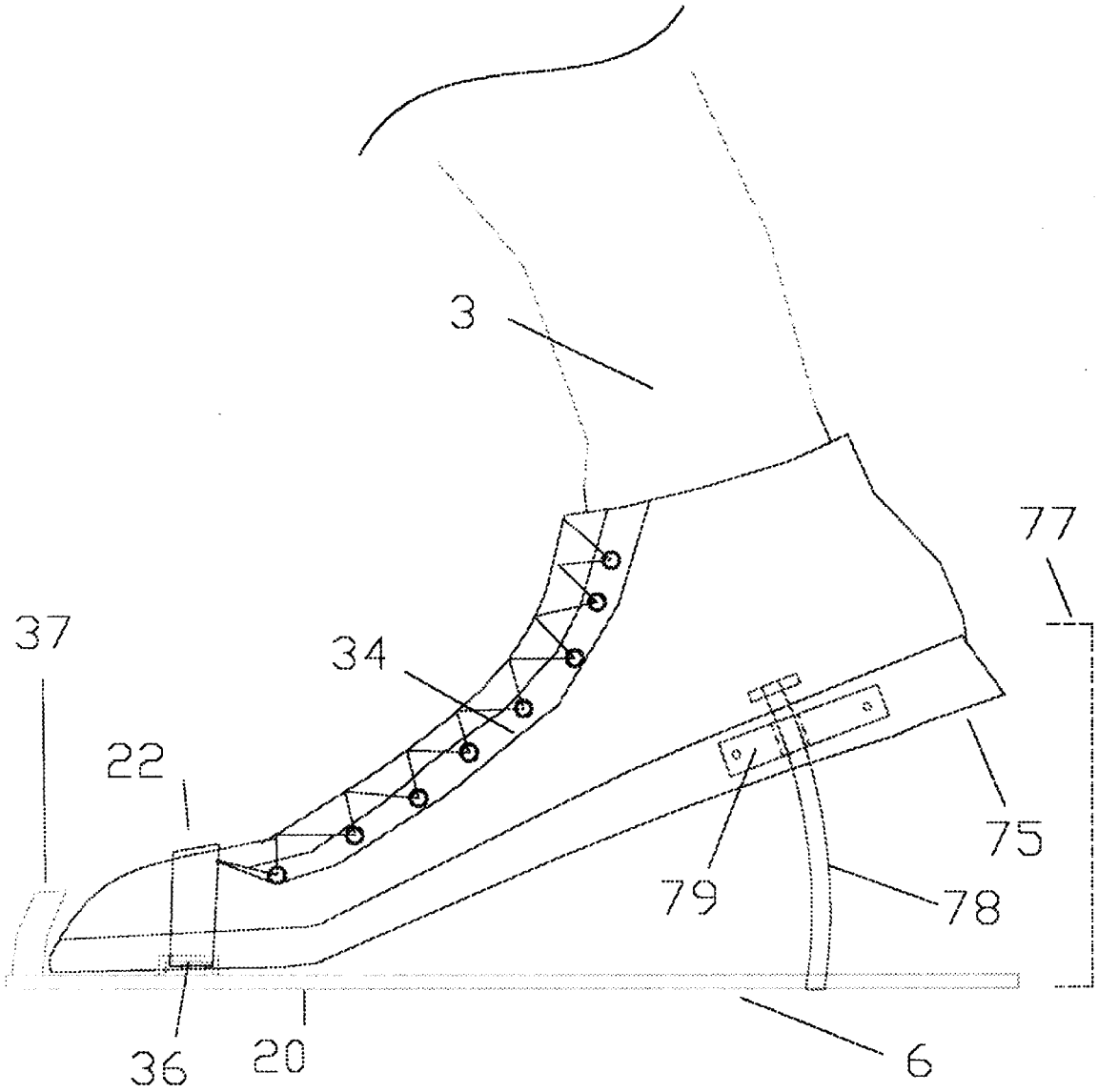
FIG. 17 is a schematic side view of the space shoe showing a rear-foot guide.
Figure 18C:
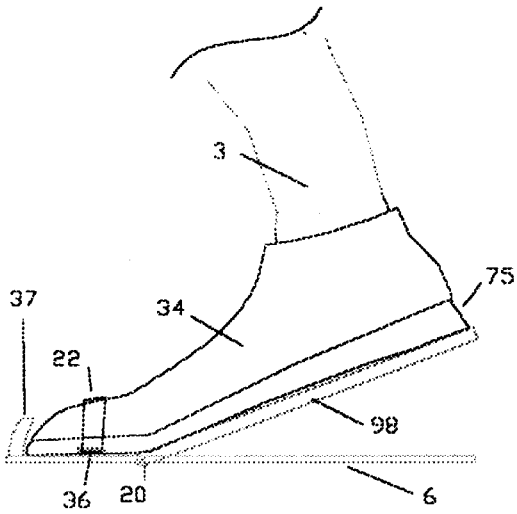
FIG. 18 is a schematic side view of the space shoe showing various designs of push-off frames.
Figure 18D:
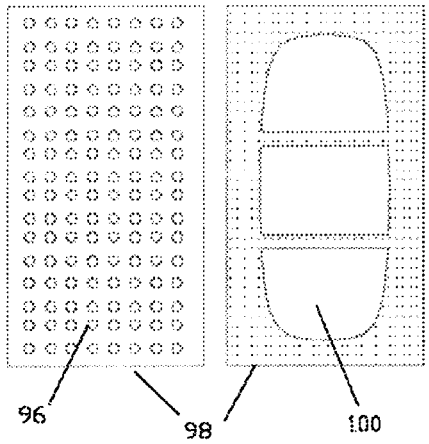
Figure 18B:
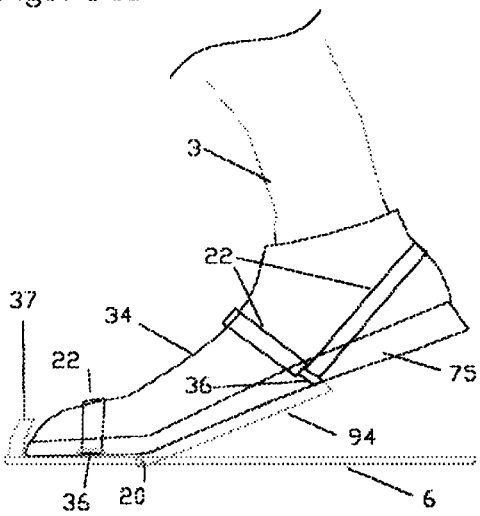
Figure 18E:
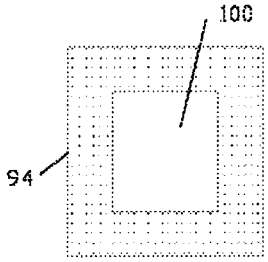
Figure 18A:
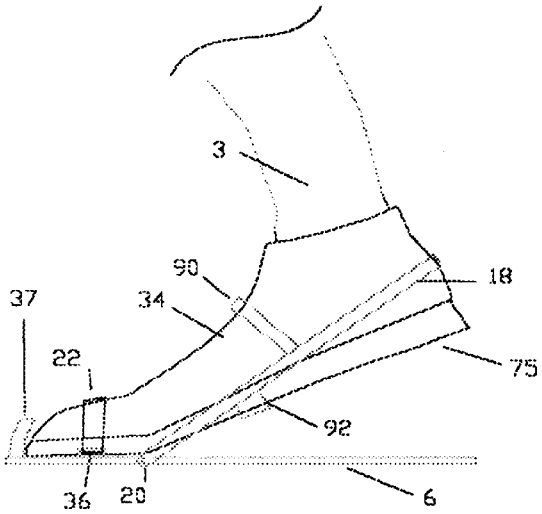
Figure 18F:
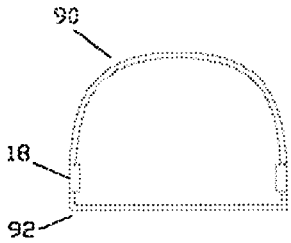

FIG. 17 is a schematic side view of the space shoe showing rear-foot guide 77 comprising guide rod 78 fixably attached to upper frame 6 which slides within guide housing 79, fixably attached to shoe sole 75, thereby constraining the heel of wearer's foot 1 to move vertically with respect to upper frame 6. Here, rear-foot guide 77 also prevents wearer's foot 1 from sliding back out the shoe straps 22 which confine the toe section of pre-existing shoe 34.

FIG. 18 is a schematic side view of the space shoe showing various designs of push-off frames 18. FIG. 18*a* shows push-off frame 18 located at a level above the shoe sole 75 and extended around the back of pre-existing shoe 34. Optional top brace 90 and optional bottom brace 92 may connect and brace the side elements of push-off frame 18 as also shown in the top view, FIG. 18*f*. FIGS. 18*b* and 18*e* show side and top views of part-way push-off frame 94 which extends only part way along the rear section of pre-existing shoe 34. The top view shows optional frame voids 100 which lighten the weight when push-off frame may extend below pre-existing shoe 34. FIGS. 18*c* and 18*d* show side and top views of bottom push-off frame 98 which extends below pre-existing shoe 34. The top view shows optional holes 96 and frame voids 100 which lighten the weight and provide ventilation of the wearer's foot in case no pre-existing shoe is used.

Figure 19C:
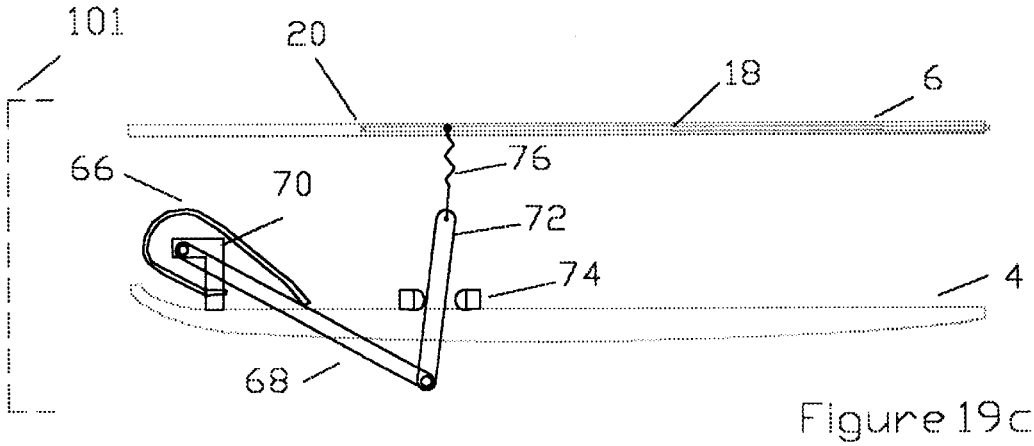
FIG. 19 is a schematic side view of the space shoe showing examples of heel huggers which close the toe hinge so that the rear lower part of the space shoe does not flop below the wearer's heel during swing phase.
Figure 19B:
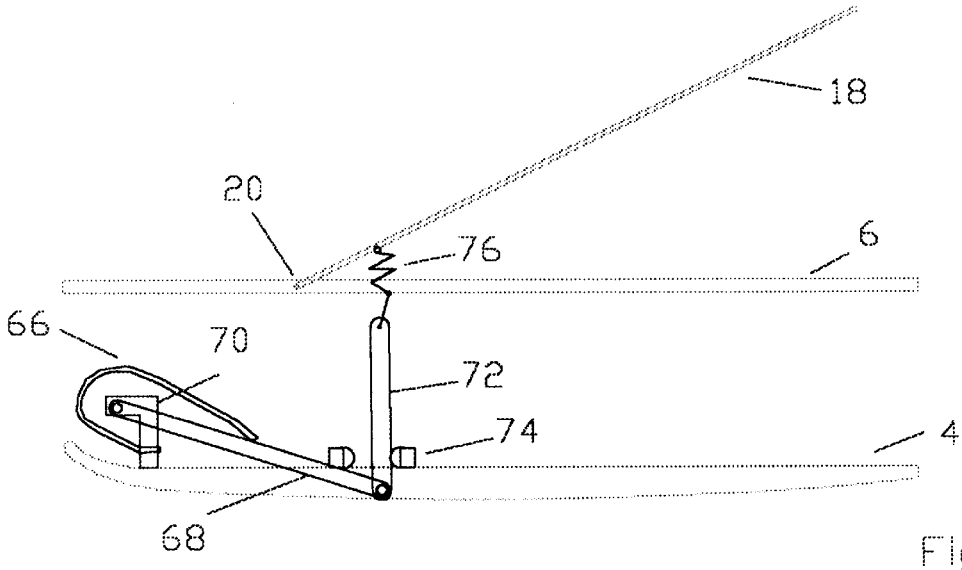
Figure 19A:
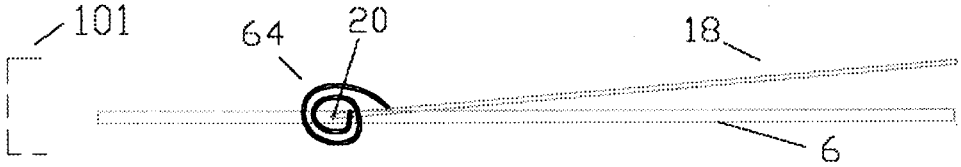

FIG. 19 is a schematic side view of the space shoe showing heel huggers 101 which close toe hinge 20 so that the rear lower part of the space shoe does not flop below the wearer's heel during swing phase. P-diamond linkage 9 is not shown to make it easier to view this mechanism. FIG. 19*a* uses simple hinge spring 64, which may be a torsion spring, to bias push-of frame toward the rear of upper frame 6. FIGS. 19*b* and 19*c* show a more robust "zero-force" heel hugger 101 which only acts to close toe hinge 20 in swing phase so that the wearer does not need to work against the closing spring while pushing off. In FIG. 19*b* toe lever 68 has been pushed up by ground contact, causing drive link 72 to move up through drive link guide 74 and create slack in hinge spring 76. In swing phase (FIG. 19*c*), toe-lever spring 66 biases toe lever 68 down to pull down on hinge spring 76 and therefore to pull down on push-off frame 18—closing toe-hinge 20.

FIG. 20 is a schematic top view of the space shoe showing "low-eccentricity" heel huggers 101. Again, p-diamond linkage 9 is not shown to make it easier to view this mechanism. This particular design does not resist heel-lift as the heel lifts beyond an certain angle. Also, as the heel descends, the force which lifts the rear upper frame 6 to contact push-off frame 18 (actually the wearer's heel), increases linearly, and this the opposite of the force curve of simple hinge spring 64 in FIG. 19*a* which decreases linearly as contact approaches. The result for FIG. 20 is that upper frame 6 "hugs" the wearer's heel strongly in swing phase while the force that would cause this contact to slam together is reduced. To further suppress clicking or slamming at contact, push-off stop 16, which could be a bladder or gel, e.g., can also be used. Two similar designs are shown in FIG. 20. The first design, of FIGS. 20*a, b, & c,* uses tension spring 108 and is located between upper frame 6 and lower frame 4—limiting the compression of p-diamond sole 8. For applications where stops or springs also limits this compression, this design works fine. The second design, of FIGS. 20*e, f, & g,* uses push spring 118 and is located above shoe plate 8, in which case p-diamond sole 8 can fully compress.

Figure 20C:
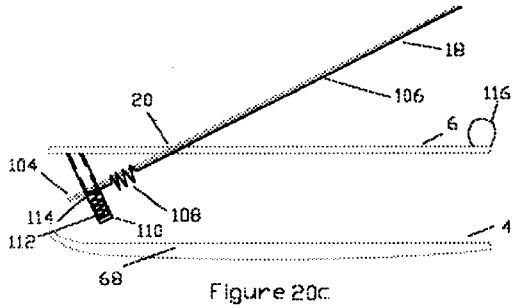
FIG. 20 is a schematic top view of the space shoe showing low-eccentricity heel hugger designs.
Figure 20F:
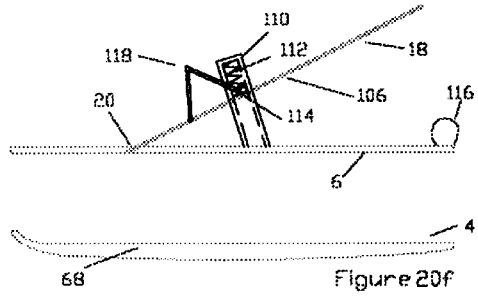
Figure 20B:
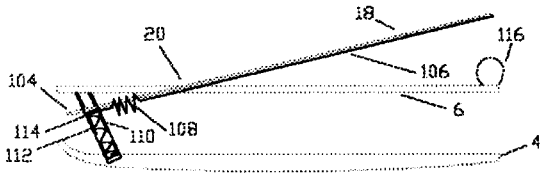
Figure 20E:
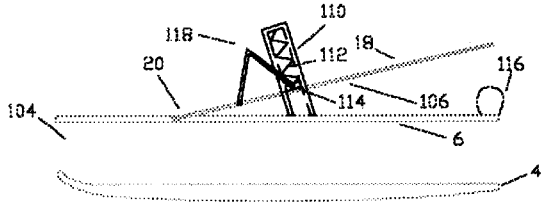
Figure 20A:
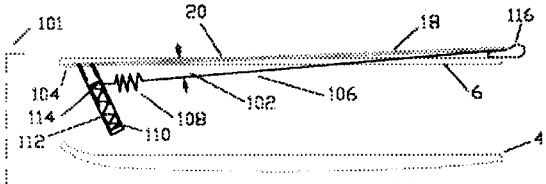

The first design, of FIGS. 20*a, b, & c,* works as follows. In FIG. 20*a* in swing phase, tension spring 108 pulls the back of push-off frame 18 into contact with shoe late 6 by virtue of the fact that eccentricity 102 of the spring force about pivot 20 is at its maximum value. Note that tension spring 108 connects the rear part of push-off frame 18, via closer cord 106, with spring catch 114 which in turn attaches to tube spring 112. Tube spring 112 is guided by spring tube 110, rigidly attached to upper frame 6. Spring catch 114 is constrained to be a chosen distance below upper frame 6 in swing phase so the eccentricity 102 (shown between the opposing arrows in FIG. 20*a*) is as large as possible within design constraints. FIG. 20*b* shows the beginning of heel-lift with push-off frame 18 raised until its front extension 104 lowers and impinges spring catch 114 at the same instant the line of force of tension spring 108 passes through toe hinge 20. Now, the eccentricity 102 of the spring force about pivot 20 is approximately zero, and push-off frame 18 can freely lift up more during which time front extension 104 pushes down spring catch 114 against tube spring 112 so that the eccentricity remains approximately zero. Tube spring 112 is even weaker than tension spring 108 which only has to lift the weight of the rear part of p-diamond sole 8. As the wearer's foot straightens in swing phase, push-off frame 18 will lower to the point where heel hugger 101 pulls upper frame 6 into full contact with the wearer's heel.

Figure 20D:
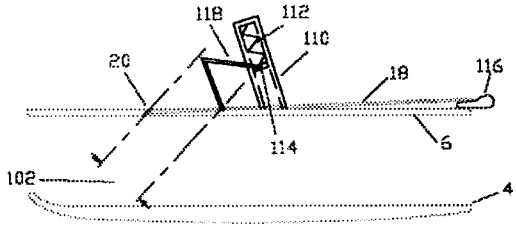

The design of FIGS. 20*d, e, & f* works in a similar manner except that push spring 118 can now be located above upper frame 6. In this case a leaf spring is used, but other compressive springs could be used as well. In FIG. 20*d,* spring tube 110, now fixably attached to the top of upper frame 6, has spring catch 114 positioned so that rotatably connected push spring 118, also rotatably connected to push-off frame 18, pushes push-off frame 18 to hug or contact upper frame 6. Note that eccentricity 102 (shown between the arrows and dashed lines in FIG. 20*d*) is now finite. In FIG. 20*e,* push spring 118 has rotated so that its line of force passes through toe hinge 20, and push-off frame 18 can lift freely. In FIG. 20*f,* push-off frame 18 has lifted spring catch 114 against tube spring 112 so that the eccentricity remains approximately zero. One could also use a mechanism similar to that shown in FIGS. 19*b & c* to make the "hugging" force zero at toe-off by using a toe-lever 68 to disengage either tension spring 108 or push spring 118 during toe-stance.

FIG. 21 is a schematic top view of the space shoe showing delayed heel-lifter 140 in the spring system to lift the runner's heel during the latter part of toe-off. The purpose is to delay the action of an impact-absorbing spring until the latter part of toe-off, and this idea can be used with conventional shoes or boots, in general. The additional benefit is the calf muscle action to plantar flex the ankle joint (in toe-off) is assisted by delayed heel lifter, and better running economy can, in principle, be achieved. Heel-lifter bow 142 is pivotly connecte3d to lower frame 6 and slidingly connected within pawl/bow pivot guide 160, which is housed in heel-lifter guide frame 144, rigidly attached to lower frame 4. Also slidingly connected within heel-lifter guide frame 144 are upper frame catch 148 and push-off ratchet 150—both of which are biased upward by elastic bands 156 via band posts 158. P-diamond linkage is shown in FIGS. 21 a and 21*c,* but not shown in FIGS. 21*b* and 21*d* due to lack of space. The spring systems shown in other figures can be used. Heel-lifter bow 142 acts in addition to those other springs.

Figure 21E:
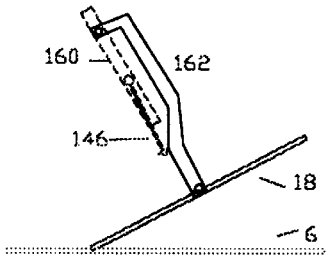
FIG. 21 is a schematic top view of the space shoe showing a delayed heel-lifter in the spring system to lift the runner's heel during the latter part of toe-off.
Figure 21D:
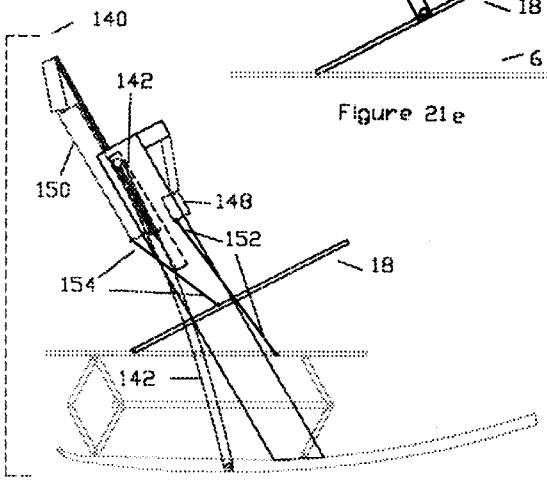
Figure 21C:
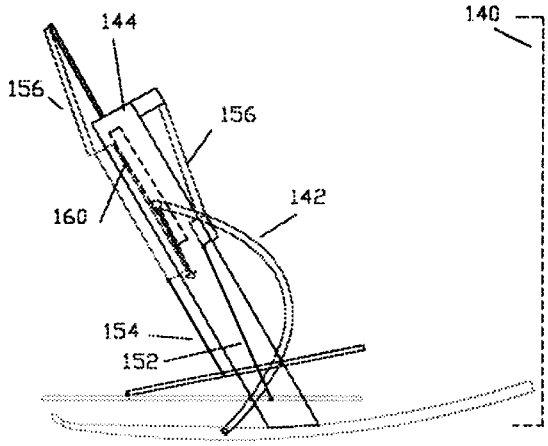
Figure 21B:
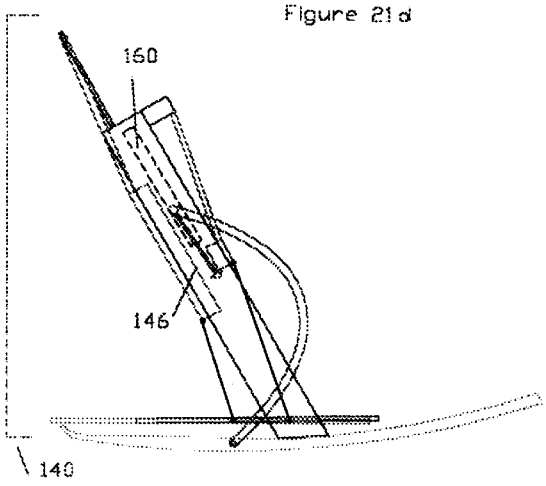
Figure 21A:
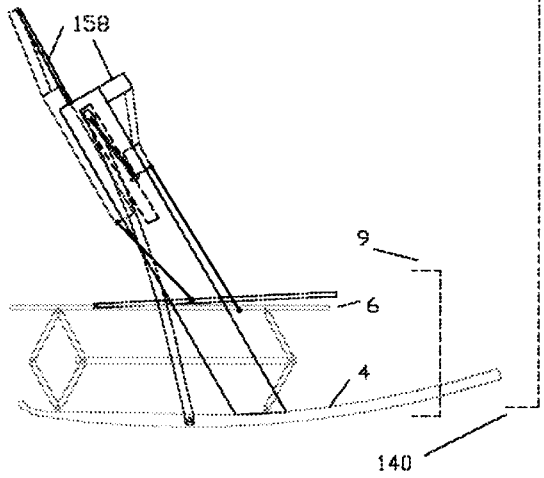

FIG. 21*a* depicts the time of heel contact. Heel-lifter bow 142 (another type of spring could be used) is loaded as upper frame catch 148 is caught by two-way pawl (biased in this direction by a simple spring not shown), and upper frame cord 152 is pulled down by upper frame 4. FIG. 21*b* shows full impact. FIG. 21*c* shows the early part of heel lift when it is too early for heel-lifter bow to act effectively. Until this chosen angle of lift of push-off frame 18, upper frame catch has been engaged, preventing heel-lifter bow 142 from straightening. Bar-bias-bar 162 pivotly connected to push-off frame 18 and constrained within with an inclined step in width will serve to bias two-way pawl 146 to disengage upper frame catch 148 and engage push-off ratchet 150 at this chosen angle as shown in FIG. 21*e.* Then, heel-lifter bow 142 is free to lift push-off frame 18 via push-off cord 154 during the latter part of toe-off. During swing phase the device returns to the configuration of FIG. 21*a* by virtue of heel hugger 101 of FIGS. 19 or 20 and the not-shown spring to bias two-way pawl counterclockwise.

The next embodiment or application of the p-diamond invention is for use with running braces. The p-diamond provides the spring and the brace foot so that the action of the running brace is very similar to the action of the runner's leg and foot. FIG. 22*a* shows a front view and FIG. 22*b* a side view of front/back brace leg 650 in which the pelvic coupling is made directly behind and in front of the runner's ischial tuberosity (buttock) rather on the side of the hip. Front hip pivot 678 is pivotly attached to harness 683 directly above runner's leg 676 in front, and back hip pivot 680 is pivotly attached to harness 683 directly above runner's leg 676 in back. Front and back—hip pivots 678 and 680, knee pivots 660 and 662, and thigh links 652 and 654—and knee cross link 674 form a four-bar system. Front and back—ankle pivots 670 and 672, knee pivots 660 and 662, and ankle links 670 and 672—and knee cross link 674 form another four-bar system—with knee pivots 660 and 662 and knee cross link 674 being shared between these two four-bar systems. The runner's pelvis and/or harness 683 act as the cross link at the hip level for the upper four-bar system, and top length link 23 acts as the cross link at the foot level for the lower four-bar system. These two four-bar systems are sufficiently distant from runner's leg 676 throughout a stride as to not interfere with the same. Back hydraulic knee lock 664 is rotatably connected to a back thigh link 654 and back tibia link 668 so that when a foot trigger (not shown, but straightforward to implement for one of ordinary skill in the art) locks back hydraulic knee lock 664 as foot strike, flexion about back knee pivot 662 is locked. Another knee lock could be used for front knee pivot 660, but this is not necessary because back knee pivot 662 is shared by both four-bar systems. That is, when back knee pivot 662 is locked, both the above-mentioned top and bottom four-bar systems are converted to three-bar systems, and both structures are locked. Folding of the upper and lower four-bar systems with respect to each other is realized as the runner's weight leans forward. This folding can be enhanced by tethering front and back knee pivots 660 and 662 to the runner's knee. The runner's foot can now be coupled to bottom length link 25 at its front, thereby permitting heel lift during toe-off.

Note the elements of the p-diamond linkage 9 are the same as in FIG. 1. The key difference here is that the runner's foot 1 is now located between the two p-diamond linkages 9, which, in turn, are rigidly connected in the front and the back by brace cross bars 682. In this way, front/back brace leg 650 supports the runner's weight in parallel with the runner's leg. Also, lengthwise spring 57 can now be positioned to be outside of p-diamond linkages 9 and to be curving upward, the runner's foot is not directly above.

Finally, if the one or both knee pivots in FIG. 22 are constrained from hyper-extending (as is commonly done with above-knee prostheses), a separate knee lock, such as back hydraulic knee lock 664, can be eliminated since the "constrained hyper-extension knee lock" naturally locks at heel-strike and naturally starts folding just before toe-off. Having a separate knee lock allows the runner to run uphill or to land with a more substantially pre-bent leg, but this capability is not needed in many applications. This is even more true for a running brace than for above-knee prostheses, since the runner's leg is there to prevent a fall.

Figure 22C:
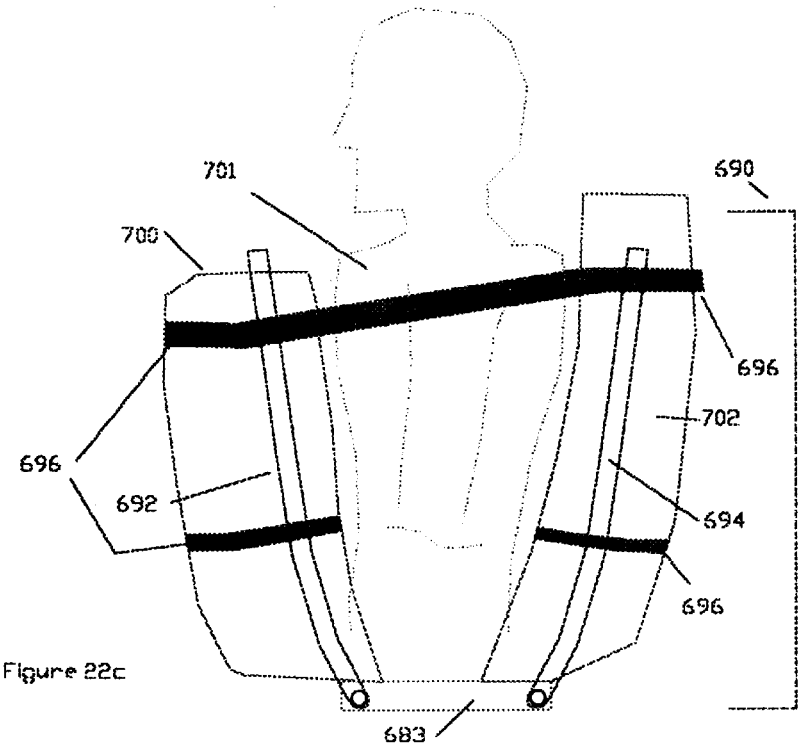
FIG. 22 shows an application of the p-diamond invention to running braces.
Figure 22A:
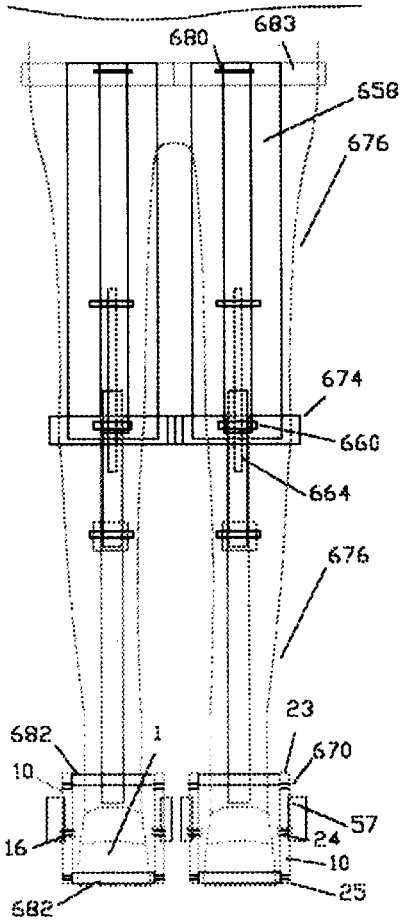
Figure 22B:
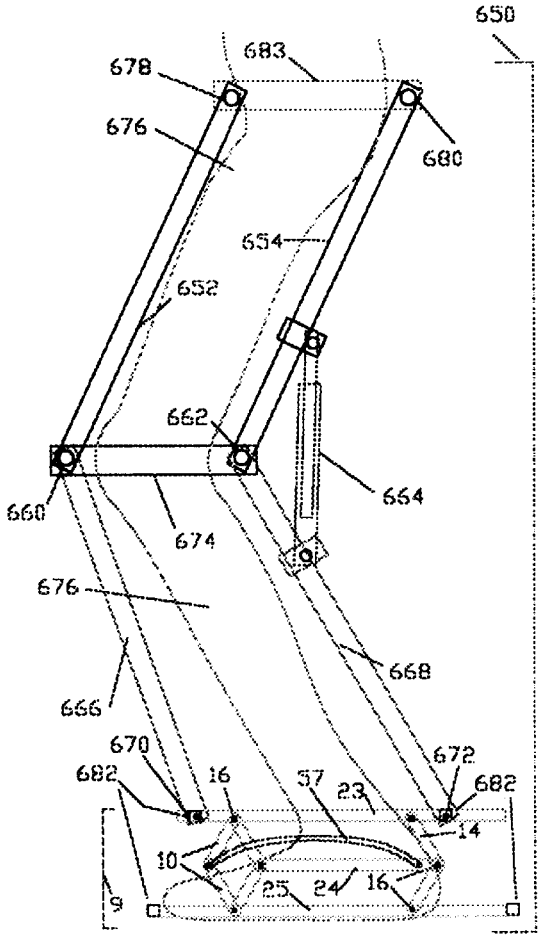

FIG. 22*c* shows the option of front/back pack extension 690 for comfortable and optimal pack load support. The running/walking brace shown is front/back brace leg 650 of FIG. 38. Front pack frame 692 is pivotly attached to the top front of front/back brace leg 650 by pack-frame pivot 698, and back pack frame 694 is pivotly attached to the top back of front/back brace leg 650 by pack-frame pivot 698. Pack straps 696 attach front pack 700 to front pack frame 692, and back pack 702 to back pack frame 694. If the brace legs were not supporting the pack weight, there would be an uncomfortably high load on the runner's shoulders. Also, the front parts of front/back pack extension 690 can be eliminated, in which case runner 1 must lean forward at the waist to balance the pack. Note that one option is for harness 683 to not couple to the pelvic region of runner 701 in a supportive manner; in this case, front/back brace leg 650 simply supports the packload. This eliminates the difficult problem of coupling to the runner and makes for an easier product.

Figures 23A, 23B, 23C:
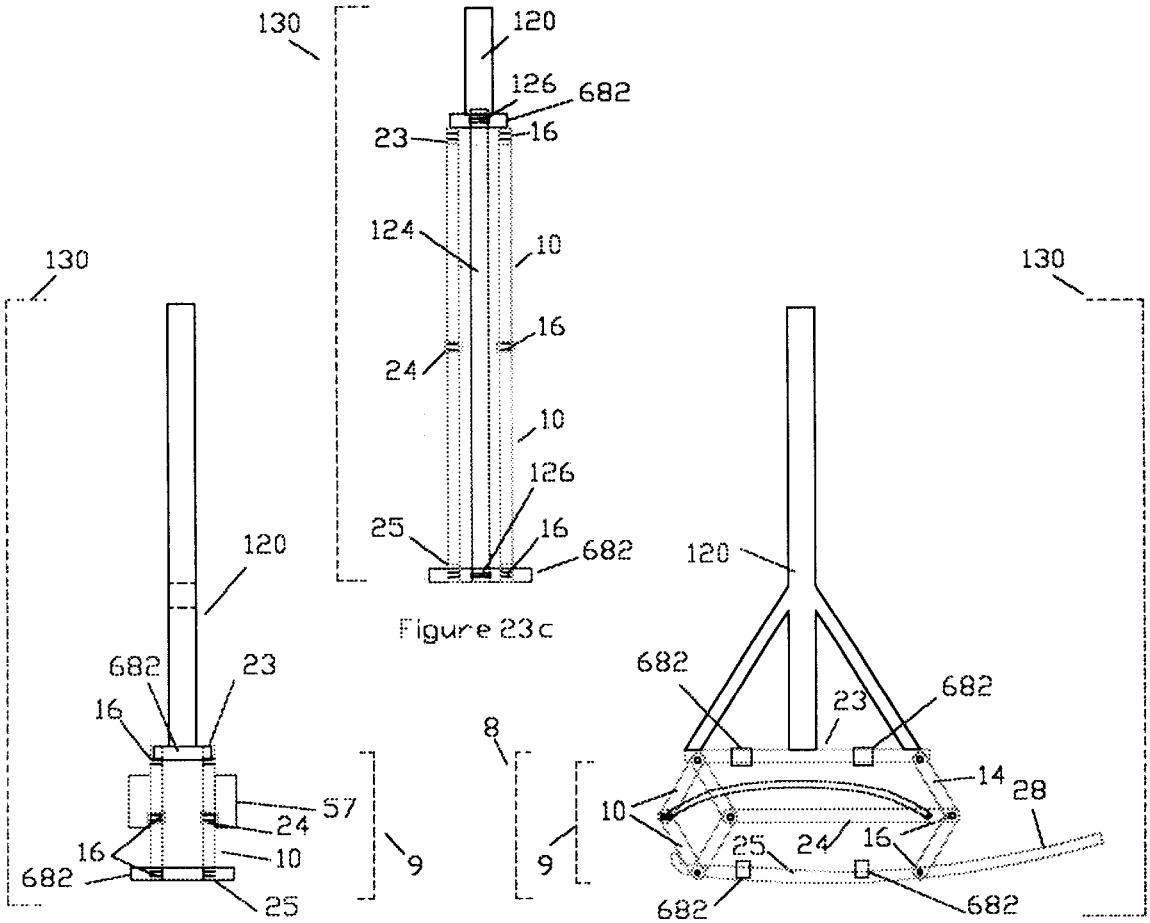
FIG. 23 shows an application of the p-diamond invention to leg prostheses

FIG. 23 (23*a* a front view and 23*b* a side view) shows another application of the p-diamond invention, namely p-diamond prosthesis 130. Pylon 120 would be attached at its top to a conventional below-knee socket engaging the stump of an amputee. Pylon 120 is rigidly attached to p-diamond sole 8 which is detailed in earlier figures. Since there is no runner's foot in this application, lengthwise springs 57 can be moved closer to the center. Also, brace cross bar 682 can be made narrower on the top, at the level of top length link 23, to allow a bow version of lengthwise spring 57 to bow upward without interference. FIG. 23*c* shows a front view or another variation of p-diamond prosthesis 130. Here, p-diamond linkage 9 is much taller (by virtue of diamond links 10 and end links 14 being much longer). The side view would be equivalent to FIG. 23*b* except for this tall feature. Now, in FIG. 23*c*, prosthetic bow spring 124 can be oriented vertically, pushing directly and vertically between brace cross bars 682 at the top and bottom of p-diamond sole 8. Prosthetic bow spring 124 is pivotly connected to brace cross bars 682 via bow spring pivots 126. Note, that vertically stacked p-diamond 27 of FIG. 4*b* can alternatively be used in the variation of FIG. 23*c*. Also, the p-diamond invention could just as well be used at the thigh level of an above-knee prostheses. Finally, the p-diamond can be used with active and passive (using springs), or combinations of the two, to aid in actuation of any limb or actuated element, such as arms, legs, necks, torsos, etc.

Figure 24C:
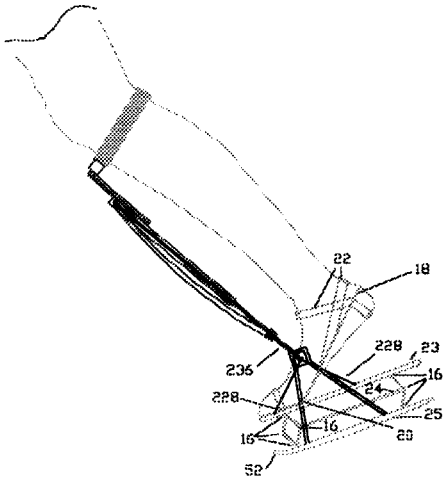
FIG. 24 is a schematic side view of the first embodiment of the bow shoe, with a shin-level bow spring and a compressible p-diamond sole.
Figure 24B:
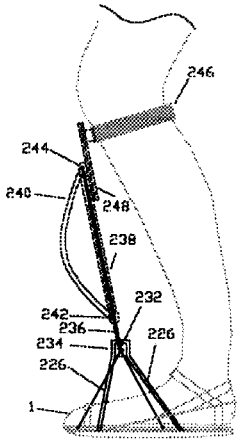
Figure 24A:
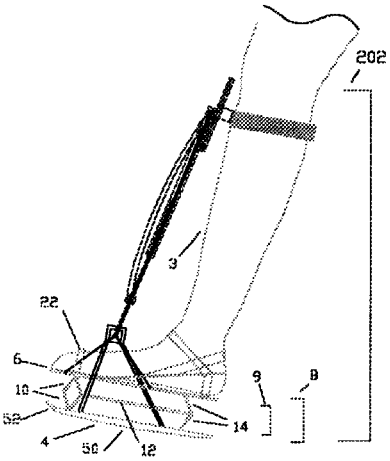
Figure 25:
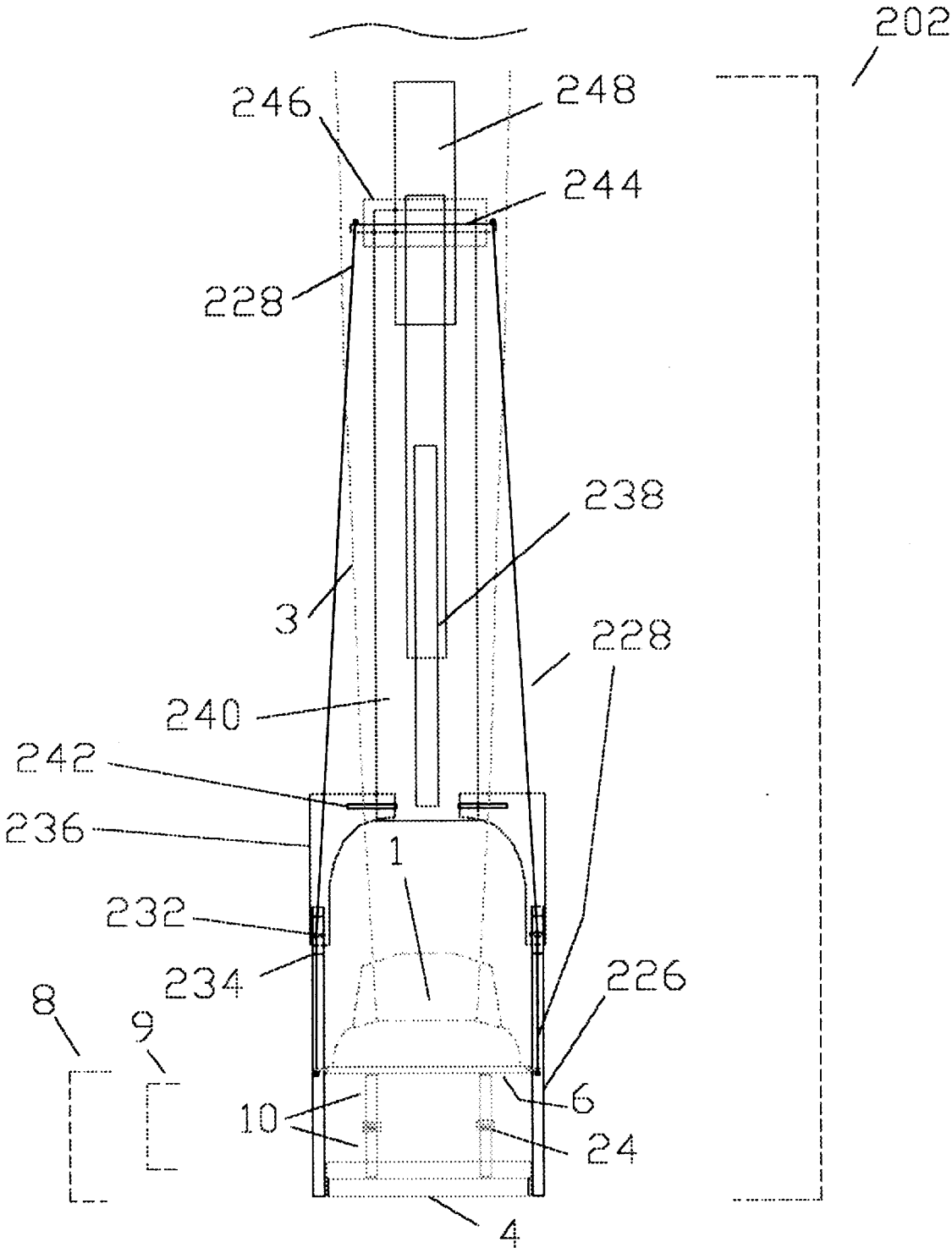
FIG. 25 is a schematic front view of the first embodiment of the bow shoe, with a shin-level bow spring and a compressible p-diamond sole.

Another application of the p-diamond invention is bow shoe 202 shown in FIG. 24 (a side view and FIG. 25 a front view). It combines shin-level bow 240 and compressible p-diamond sole 8. All details such as the various springs are not shown here, but any of the features of the space shoe discussed earlier can be incorporated into the bow shoe. FIG. 24*a* shows heel-strike, FIG. 24*b* shows mid-stance with p-diamond sole 8 compressed, and FIG. 24*c* shows toe-off. Here, p-diamond sole 8 is equivalent to that shown in FIGS. 5 and 6. Ankle-pivot supports 226 are rigidly attached on either side to lower frame 4—to support ankle-pivot housings 234 and ankle pivots 232. Stirrups 236 are pivotly connected to ankle-pivot support 226 by ankle pivot 232, and they prevent interference of the bow support section with runner's shin 3. Bow 240 is pivotly attached to stirrup 236 via lower bow hinge 242, and bow guide 238 is rigidly attached to stirrup 236. The top of bow 240 is pivotly attached to bow guide 238.

Cords 228 attach to a front and a rear side point on upper frame 6 at equal distances in front of and behind ankle-pivot support 226. Cords 228 extend up to be guided through the center of ankle-pivot housing 234 so as to minimize any torque exerted by cord 228 on bow guide 238 about ankle pivot 232. Cords 228, four in all—from the front and rear on both sides, extend further up to attach to upper bow hinge 244. Accordingly, when runner's foot 1 pushes down on upper frame 6 during foot-strike, bow 240 is loaded via cords 228. Since rear and front cords 228 are symmetrically positioned about ankle-pivot support 228 and since p-diamond sole 8 forces vertical compression, bow 240 is loaded by either or both heel and toe impact. This ensures that the full impact energy is returned through the runner's toe at toe-off. To keep bow 240 from flopping about, it is attached to shin strap 246 via shin slider 248 which is slidingly connected to the upper part of the telescoping bow guide 238.

Figure 26A:
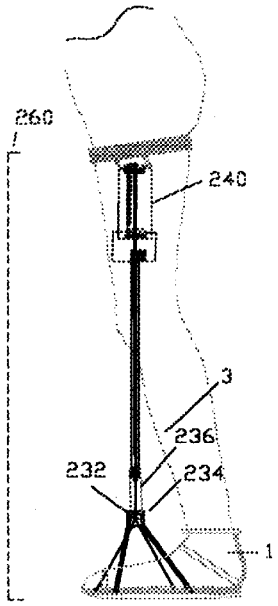
FIG. 26 is a schematic side view of the third embodiment of the bow shoe, with a thigh-level bow spring and a compressible p-diamond sole.
Figure 26B:
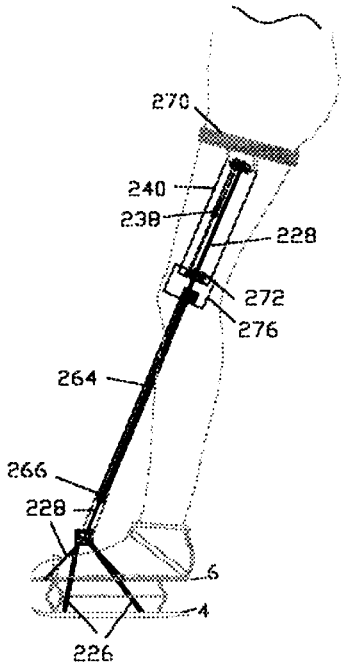
Figure 26A:
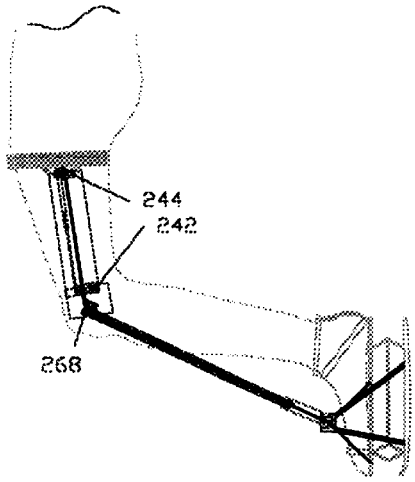
Figure 27:
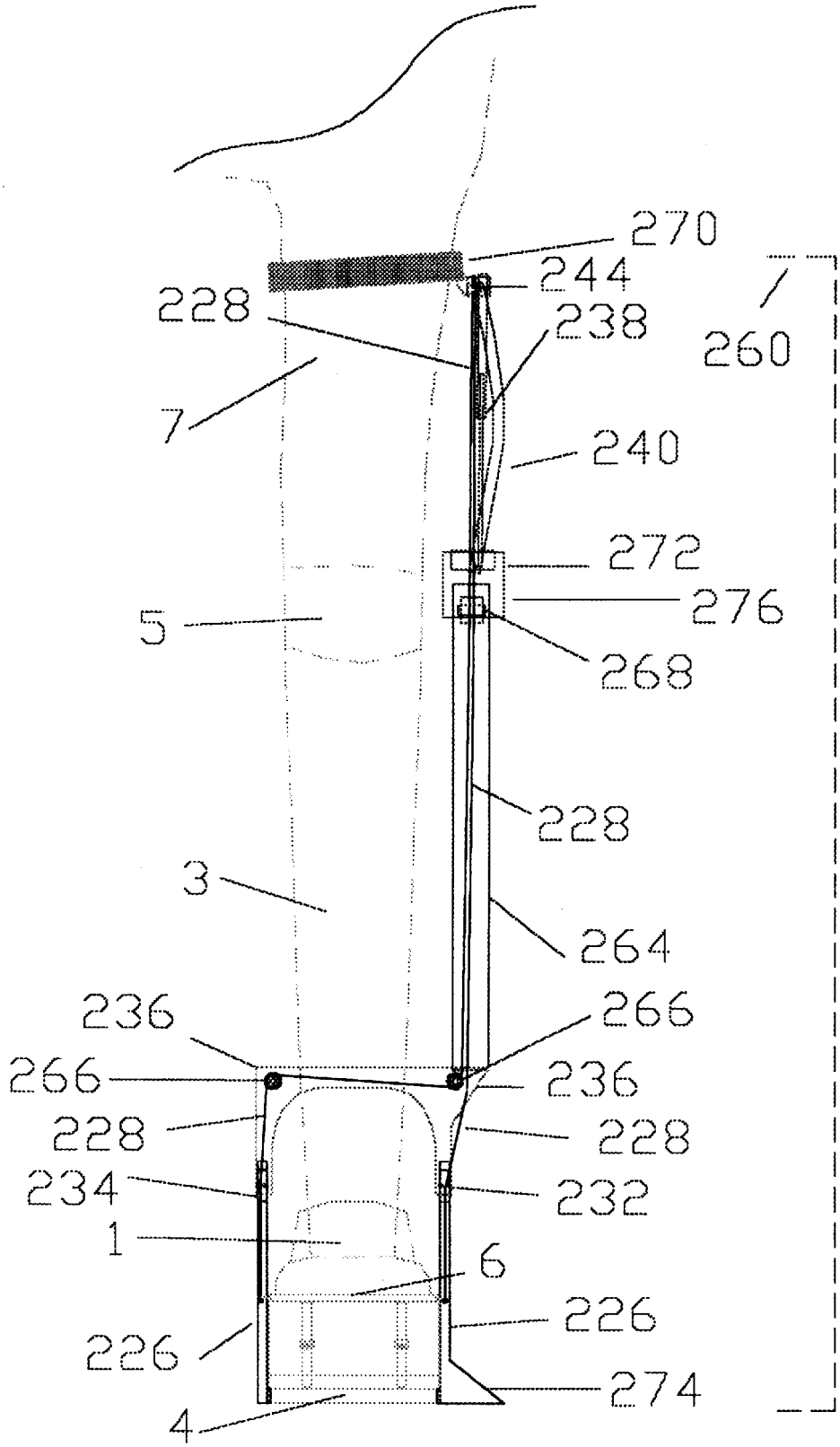
FIG. 27 is a schematic front view of the third embodiment of the bow shoe, with a thigh-level bow spring and a compressible p-diamond sole.

FIG. 26 is a side view and FIG. 27 a front view of extended bow shoe 260, a variation of the bow shoe, with a thigh-level bow spring 240—and again using p-diamond sole 8. The section of this embodiment below ankle pivot 232 is the same as that shown and discussed in FIGS. 24 and 25 for the bow shoe. The basic idea now is to move bow 240 up to the thigh level in which case the energy cost of moving the mass of bow 240 during high kick is significantly reduced. Shin tube 264 is rigidly attached to stirrup 236 which is pivotly connected to ankle-pivot housing 234 by ankle pivot 232. Cords 228 pass through ankle pivot 232 and extend up through shin tube 264. The critical design benefit in this embodiment is that side knee pivot 268 allows bow 240 to not rotate with the runner's tibia during high kick. In order to transmit the bow force via cords 228, these must be guided through the approximate center of side knee pivot 268; this detail will be shown in FIG. 28. Shin tube 264 is pivotly attached to knee-pivot housing 276 which is pivotly attached to side bow holder 272 and which is rigidly attached to the bottom of bow guide 238. Bow 240 is pivotly connected to the top bow guide 238 via upper bow hinge 244, and bow 240 is oriented to bow out to the side. Thigh straps 270 are attached to the top of extended bow shoe 260 to keep it from flopping about.

This second bow shoe embodiment functions as follows. During swing phase the tibia section of extended bow shoe 260 pivots about ankle pivot 232, and the thigh section pivots about side knee pivot 268—thereby allowing free leg swing. Knee pivot housing 276 also contains a means to straighten or align the tibia section with respect to the thigh section—to be discussed in FIGS. 28-30. According, at heel-strike this straightening ensures that there will be no reaction thrust exerted by cords 228 about side knee pivot 268 as they load bow 240 as upper frame 6 is pushed down by the runner's weight. Again, as bow 240 is loaded by either or both the runner's heel and toe, the runner's full impact energy is absorbed, and at toe-off this full energy is returned to the runner through her toe as she is pushing off.

Figure 28A:
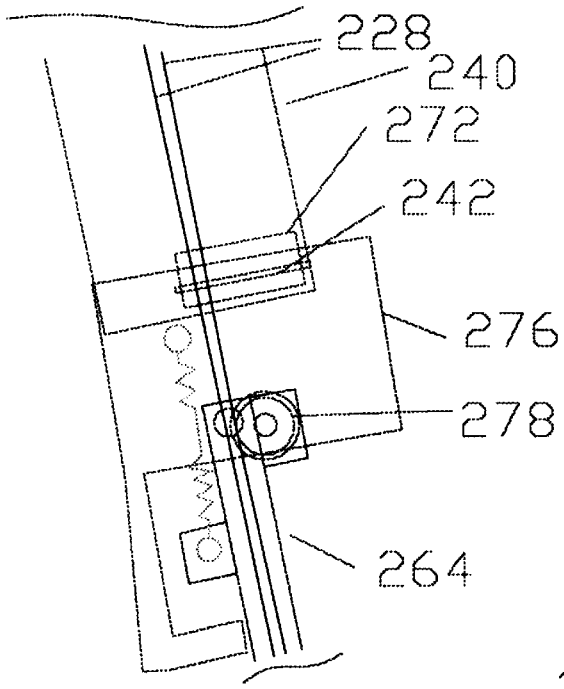
FIG. 28 shows a simple knee-joint straightener in the third embodiment of the bow shoe with a thigh-level bow spring.
Figure 28B:
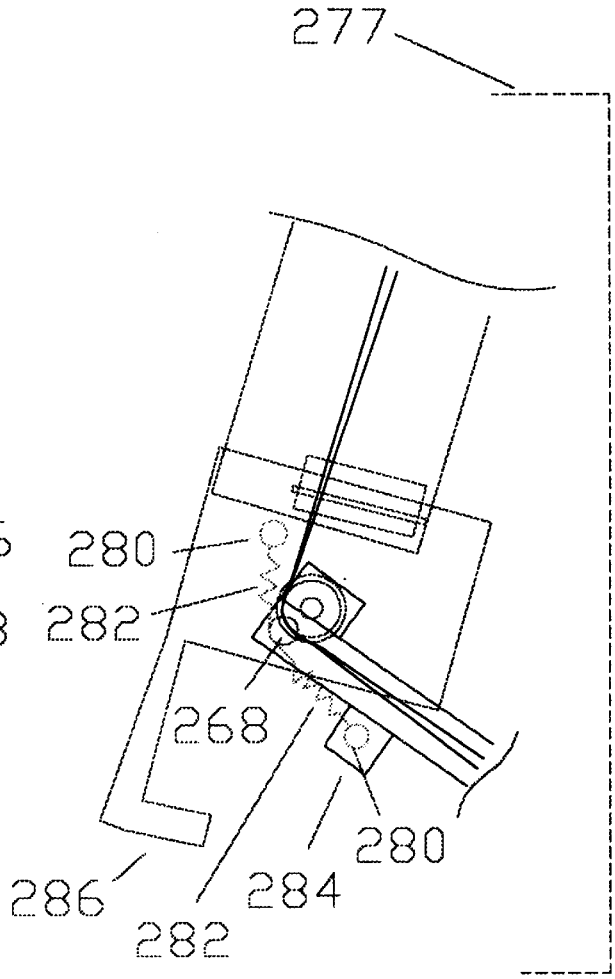

FIG. 28 shows a simple knee-joint straightener 277 in the second embodiment of the bow shoe with a thigh-level bow spring. The idea is to bias this straightening more strongly when the knee joint 268 is somewhat folding and less strongly when the knee joint 268 is very folded. One spring post 280 is fixedly attached to knee-pivot housing 276, and the other to shin tube 264 via post tab 284. Straightening spring 282 connects these two posts on the outside (forward side) of side knee pivot 268. When side knee pivot is somewhat bent, the eccentricity of the force of straightening spring 282 about side knee pivot 268 is larger, and the straightening force is larger. As side knee pivot 268 folds, straightening spring 282 moves to touch knee pivot 268, and the eccentricity and straightening force become very small—allowing easy free kick. Straightening spring 282 may comprise a small cord connecting two springs wherein this small cord easily wraps around side knee pivot 268. Or, straightening spring 282 may be positioned so that it passes through the line concentric with side knee pivot 268 in which case the spring force acts to aid the folding action as high kick continues.

FIG. 29 shows robust knee-joint straightener 300 in the embodiment of the bow shoe with a thigh-level bow spring for guaranteeing full straightening of extended bow shoe 260 of FIG. 27 at foot strike. The idea is to route closer cord B 324 around a path which passes both on the front side and back side of side knee pivot 268 in such a manner that the back part of the path (between top inside post 304 and inside pulley 328) increases faster than the front part of the path (between top outside post 302 and outside pulley 326) as shin tube 264 and bow guide 238 unfold about side knee pivot 268. By choosing a certain length of closer cord B 324, closer cord B 124 becomes taut at a particular flexion angle as the unfolding occurs, causing closer cord B 324 to begin to pull on closing spring 310 which acts to accelerate the unfolding, especially if closing spring 310 is pre-loaded (which is easily accomplished with a plug (not shown) on closer cord B 324 just below the bottom of notched tube 308). Top outside post 302 and top inside post 304 are fixably attached to bow guide 238. Bottom outside post 330 and bottom inside post 332 are fixably attached to shin tube 264—providing support for outside pulley 326 and inside pulley 328. Notched tube 308 is attached to top outside post 302 by reset spring 320. Closer cord B 324 is attached to notched tube 308 via closing spring 310 which is stronger than reset spring 320. Notched tube 308 is slidably connected to thigh link 4 via notched-tube guide 306. Pawl 312 is pivotly connected to thigh link 4 at pawl pivot 316 via pawl tab 314 (fixably attached to thigh link 4). Pawl spring 318 biases pawl 312 to engage the notch in notched tube 308 when it is pulled upward in swing phase by reset spring 320.

Figure 29A:
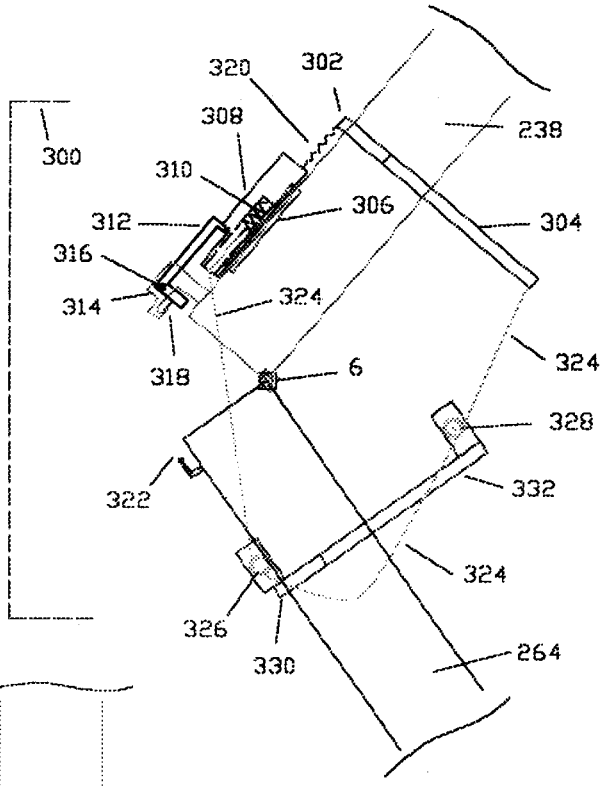
FIG. 29 shows a robust knee-joint straightener in the third embodiment of the bow shoe with a thigh-level bow spring.
Figure 29C:
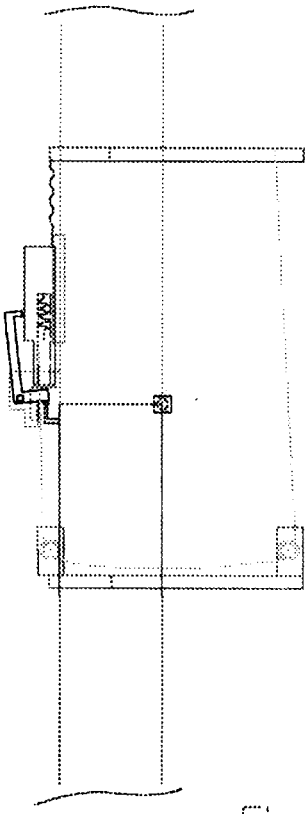
Figure 29B:
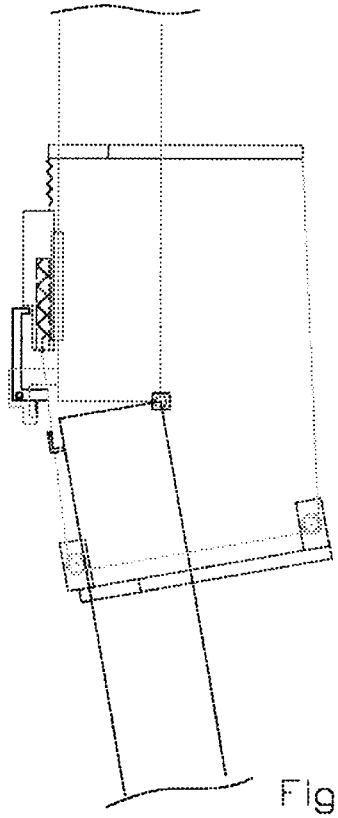

Accordingly, FIG. 29*a* shows robust knee-joint straightener 300 in swing phase when closer cord B 324 is slack and there is no unfolding force—allowing the shin tube 264 to swing freely. Reset spring 320 has pulled notched tube 308 up so that pawl 312 can engage its notch. Again, at a particular flexion angle closing spring 310 slams shin tube 264 closed as seen in FIG. 29*b*. Just after the joint fully extended, pawl bumper 322 impinges the bottom of pawl 312 causing it to disengage from the notch of notched tube 308, thereby releasing closing spring 310 from its folding force because notched tube 308 moves down notched-tube guide 306—shortening the patch of closer cord B 324 (shown in FIG. 29*c*) and causing it to become slack. Thus, there is no closing force later, at toe-off, to resist folding and high kick. Robust knee-joint straightener 300 is robust because it does not require any trigger from the foot or the hip to work. That is, the release of the closing force is keyed to straightening of side knee pivot 268.

Figures 30A, 30B, 30C:
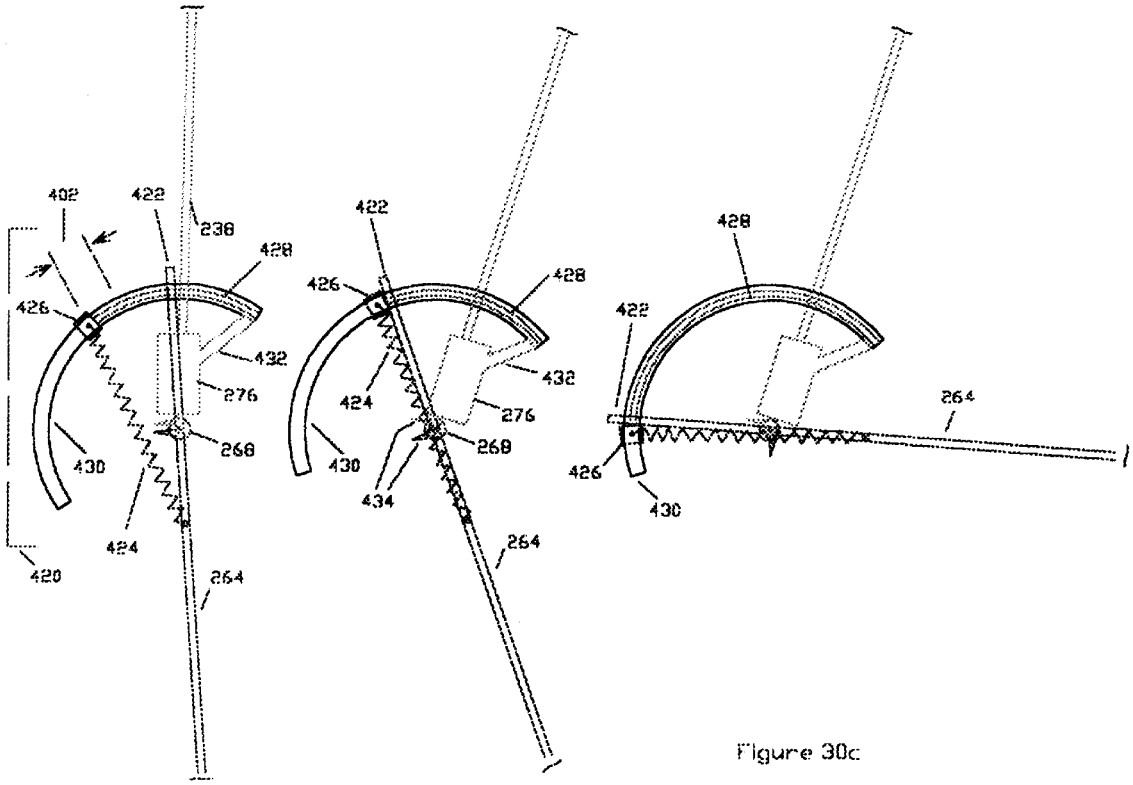
FIG. 30 is a schematic side view of the bow shoe showing a low-eccentricity knee-joint straightener.

FIG. 30 is a schematic side view of the bow shoe showing low-eccentricity knee-joint straightener 420. Its working principle is very similar to that of low-eccentricity heel huggers 101 of FIG. 20. It resists folding about side knee pivot 268 with only a very small force (of circle spring 428) beyond a chosen flexion angle so that the wearer is free to high kick. As shin tube 264 descends beyond this chosen flexion angle, low-eccentricity knee-joint straightener 420 acts to accelerate this straightening via close spring 424 with a force that increases proportional to eccentricity 402 of the spring force about side knee pivot 268. Thus, the greatest straightening force acts when full straightening occurs. Tile components are assembled as follows. Circle tube 430 is rigidly attached to bow guide 238 and circle brace 432 which extends from knee-pivot housing 276. Slide ring 426 slides along circle tube 430, and it is connected both to close spring 424 (which extends down to connect to shill tube 264) and to circle spring 428 which extends through circle tube 430 to connect the upper end of circle tube 430. Slide ring 426 is constrained from sliding up and to the right at a chosen location. Pivot stops 434 prevent hyper-extension about side knee pivot 268. In FIG. 30*a,* the configuration is straight, eccentricity 402 (between the opposing arrows) is at a maximum value, and the straightening force is at a maximum value. In FIG. 30*b,* shin tube 264 has folded to the point where shin-tube extension 422 impinges slide ring 426, eccentricity 402 is very small, and the straightening force due to close spring 424 is very small. In FIG. 30*c,* shin tube 264 has folded considerably. However, the straightening force due to close spring 424 is still very small because slide ring 426 is forced to slide around circle tube 430 by shin-tube extension 422 and eccentricity 402 remains very small. There is still a very small resistance to folding due to circle spring 430 which is much weaker than close spring 424. Again, as straightening progresses beyond the configuration of FIG. 30*b,* the straightening force increases rapidly.

What is claimed is:

1. A space shoe comprising a p-diamond sole, a compression limiting mechanism to limit the compression of said p-diamond sole, and a foot attachment means to attach said p-diamond sole to the foot of a wearer, wherein said p-diamond sole is a compressible structure, called a p-diamond, comprising an upper frame, a lower frame, one or more a p-diamond linkages each of which comprises eight links further comprising four diamond links, two end links, a top length link, a center length link, a bottom length, link wherein said nine links are hingeably connected by link hinges, wherein said top length link is rigidly attached to said upper frame, and said bottom length link is rigidly attached to said lower frame, wherein the four said diamond links are hingeably interconnected by said link hinges to form a diamond shape, with two top links and two bottom links wherein two diamond links with one bottom link, are called outside diamond links because they face away from the center of said p-diamond and the other two diamond links are called inside diamond links, wherein the two outside diamond links must be equal in length and the two inside diamond links must be equal in length with each other and with the two said end links, wherein a top link hinge connecting the top two said diamond links is hingeably connected to said top length link, wherein a bottom link hinge connecting the bottom two said diamond links is hingeably connected to said bottom length link, wherein the two said outside diamond links are hingeably connected by a link hinge called the outside link hinge, and the two inside diamond links are hingeably connected by a said link hinge called the inside link hinge, wherein said top length link is also hingeably connected to one of said end links, and said bottom length link is also hingeably connected to the other one of said end links, wherein said end links are hingeably interconnected by a link hinge called the end center link hinge, wherein said center length link is connected to said inside link hinge and said end center link hinge, wherein the overall configuration of said eight links of said p-diamond linkage is two parallelograms and a diamond which overlap one another and which is why the invention is referred to as a p-diamond, wherein the two said outside diamond links constrain said p-diamond to compress in such a manner that said top length link remains parallel to said bottom length link which means said p-diamond compresses without tilting.

2. The space shoe of claim 1 wherein said compression limiting mechanism comprises a stop means to rigidly stop compression, wherein said stops means could be a rigid beam located between said lower frame and said upper frame or a tether connecting said outside link hinge to said inside link hinge.

3. The space shoe of claim 1 wherein said compression limiting mechanism comprises a spring system to store and return impact energy caused by compressive forces on said p-diamond.

4. The space shoe of claim 1 wherein said compression spring system comprising one or more vertical springs acting between said lower frame and said upper frame, wherein said vertical springs may be one of many types such as helical springs, coiled springs, leaf springs, or bow springs.

5. The space shoe of claim 4 wherein said spring system comprises one or more horizontal springs acting between said inside link hinge and said center length link, wherein said one or more horizontal springs may be attached at any location along the length of said center length link, wherein said one or more horizontal springs may be one of many types such as helical springs, coiled springs, leaf springs, or curved-bow springs.

6. The space shoe of claim 5 wherein said horizontal spring has a force curve which allows the force curve of said spring system to be approximately constant over the compression of said p-diamond.

7. The space shoe of claim 1 wherein said p-diamond linkage further comprises a mirrored p-diamond linkage which adds to the original p-diamond linkage the mirrored image or structure of said p-diamond linkage, minus said outside diamond links, wherein said mirrored image comprises a second center length link, a second top length link, a second bottom length link, and two second end links, wherein said second top length link is hingeably connected to said top link hinge, said second bottom length link is hingeably connected to said top link hinge, and said second center length link is hingeably connected to said outside link hinge.

8. The space shoe of claim 1 wherein said p-diamond linkage further comprises a stacked p-diamond linkage comprising one or more p-diamond linkages stacked, one above the next, and attached, one to the next.

9. The space shoe of claim 1 wherein said link hinges comprise necked hinges which are monolithic with said nine links and which flex due to being necked down to a small width at the hinge location.

10. The space shoe of claim 1 wherein said upper frame further comprises a push-off means including a push off frame which allows said wearer to flex his metatarsal joint, push off his toe, and lift his heel as he rocks forward onto his toe during push-off, wherein said push-off means constrains the heel of said wearer to raise and lower vertically with respect to said upper frame.

11. The space shoe of claim 1 wherein said p-diamond linkage is oriented longitudinally along the wearer's foot.

12. The space shoe of claim 1 wherein said p-diamond linkage is oriented transversely across the wearer's foot.

13. The space shoe of claim 1 wherein said lower frame comprises a curved bottom.

14. The space shoe of claim 1 wherein said foot attachment means comprises straps and buckles to attach a pre-existing shoe to said space shoe.

15. The space shoe of claim 1 wherein said foot attachment means comprises straps, buckles, a toe cup attached to the front of said upper frame, and a heel cup attached to the rear of said push-off frame, wherein a pre-existing shoe or simply the foot of said wearer can be confined to said space shoe by said straps, said toe cup and said heel cup.

16. The space shoe of claim 10 wherein said space shoe further comprises elastic outer walls connecting said push-off frame and said upper frame with said lower frame.

17. The space shoe of claim 1 wherein said p-diamond linkage has an end-on profile of an hourglass shape which is wide at the top and bottom and narrow in the center.

18. The space shoe of claim 1 wherein said p-diamond linkage has an end-on profile of a pedestal shape which is wide at the top and narrow at the bottom.

19. The space shoe of claim 1 wherein said lower frame comprises at least one flex-rigger, flexibly attached to a side of said lower frame so that said at least one flex-rigger can bend or rotate in a horizontal plane but not in a transverse-vertical plane, wherein said at least one flex-rigger is biased to stick approximately straight out to the side, wherein said at least one flex-rigger is dimensioned and constructed to resist sideways tipping over of said space shoe which could cause said wearer to sprain his ankle, wherein said at least one flex-rigger can optionally be compressed inward along its length.

20. The space shoe of claim 10 wherein said push-off means comprises a toe cup fixably attached to the front of said upper frame, wherein this is the only location of said foot attachment means, wherein said toe cup may optionally further comprise straps.

21. The space shoe of claim 10 wherein said push-off means comprises a rear-foot guide to constrain the heel of said wearer to raise and lower vertically with respect to said upper frame.

22. The space shoe of claim 10 wherein said push-off means comprises a toe hinge connecting a push-off frame to said upper frame in the region of, or behind, the wearer's metatarsal joint, wherein said push-off frame allows said wearer to lift his heel as he rocks forward onto his toe during push-off, wherein said push-off frame constrains the heel of said wearer to raise and lower vertically with respect to said upper frame, wherein said push-off frame extends a variable distance back toward and around the heel of said wearer, wherein said push-off frame is located at a variable level from the level of the bottom of the foot of said wearer to a level a variable distance above the level of the bottom of the foot of said wearer, wherein said push-off frame extends a variable distance beneath the bottom of the foot of said wearer.

23. The space shoe of claim 22 wherein said toe hinge comprises a necked hinge which flexes due to being necked down to a small width at the hinge location.

24. The space shoe of claim 22 wherein said push-off frame comprises a heel hugger which closes said toe hinge so that the rear lower part of the said p-diamond sole does not flop or hang below the heel of said wearer during swing phase, wherein said push-off frame remains in contact with the rear section of said upper frame during swing phase.

25. The space shoe of claim 24 wherein said heel hugger comprises a zero-force heel hugger comprising a toe lever pivotally connected to said lower frame, a toe-lever spring biasing said toe lever to extend below said lower frame, a drive link pivotally connected to said toe lever, a drive link guide attached to said lower frame for guiding said drive link upward, a hinge spring connecting said drive link to said push-off frame, wherein ground contact of said lower frame pushes said toe lever to drive said drive link up and relax the pull of said toe-lever spring to close said push-off frame against the rear part of said upper frame, wherein in swing phase said toe-lever spring closes said push-off frame against the rear part of said upper frame.

26. The space shoe of claim 24 wherein said heel hugger comprises a low-eccentricity heel hugger comprising a bias spring connected to said push-off frame, a spring tube rigidly attached to said upper frame, a tube spring housed within said spring tube, a spring catch pushed by said tube spring toward said upper frame and rotatably attached to said bias spring, wherein said bias spring biases said push-of frame to contact the rear part of said upper frame, that is to close it, when said push-off frame is rotated below a threshold angle, wherein said spring catch compresses a tube spring and said spring catch to move to align the line of force of said bias spring along the direction of said push-off frame and passing approximately through said toe hinge, wherein the torque due to said bias spring to close said push-off frame remains very small as said push-off frame continues to rotate beyond said threshold angle.

27. The space shoe of claim 1 wherein said space shoe further comprises a front/back brace leg further comprising a harness for coupling to a wearer's pelvis, a front hip pivot, a back hip pivot, a front thigh link pivotly attached to the front of said harness with said front hip pivot, a back thigh link pivotly attached to the front of said harness with said back hip pivot, a front tibia link pivotly attached to the front of said brace foot, a back tibia link pivotly attached to the back of said brace foot, a front knee pivot connecting said front thigh link and said front tibia link, a back knee pivot connecting said back thigh link and said back tibia link, one or more hyper-extending knee pivot locks at the locations of said front and back knee pivots to prevent pivot hyper-extension, an optional back hydraulic knee lock pivotly attached to said back thigh link and said back tibia link, an optional front hydraulic knee lock pivotly attached to said front thigh link and said front tibia link, a front ankle pivot for the connection of said front tibia link to said upper frame, a back ankle pivot for the connection of said back tibia link to said upper frame, a knee cross link connecting said front knee pivot with said back knee pivot, wherein said front and back hip pivots are located approximately above the center of each leg, wherein the front and back locations of said brace leg elements prevents interference with said runner's legs.

28. The space shoe of claim 27 wherein said harness comprises a front/back pack extension further comprising a front pack-frame pivot at the front of said harness, a back pack-frame pivot at the back of said harness, a front pack frame attached to the front of said harness via said front pack-frame pivot, a back pack frame attached to the back of said harness via said back pack-frame pivot, pack straps, a front pack secured to said front pack frame by said pack straps, and back pack secured to said back pack frame by said pack straps, wherein said brace legs continuously support said front and back packs as said wearer walks or runs.

29. The space shoe of claim 1 wherein said space shoe acts as a prosthetic leg, wherein said space shoe further comprises a pylon attached to said upper frame, wherein said pylon attaches to the stump of an amputee's leg.

30. The space shoe of claim 1 wherein said space shoe is a component of a robotic limb or a robotic actuated part.

31. The space shoe of claim 4 which further comprises a bow shoe for use by a runner, wherein said spring system comprises a bow spring located above said upper frame and hingeably connected to said upper frame, a leg attachment means for attaching said bow spring to the leg of said runner, a suspension system connecting the top of said bow spring to said lower frame, wherein the force of both the runner's toe and heel cause said bow spring to be loaded throughout foot-strike, wherein heel impact energy is not returned prematurely at the beginning of push-off, but rather is returned optimally during toe-off during the latter part of push-off.

32. The bow shoe of claim 31 wherein said suspension system comprises one or more ankle-pivot supports rigidly attached to said lower frame and extending around and above the level of the top of the foot of said runner, one or more ankle-pivot housings rigidly attached to said ankle-pivot support and housing an ankle pivot, one or more cords attached to said upper frame and passing around the foot of said runner and through said ankle-pivot housings, and a cord guide to constrain said cords to the location of said ankle-pivot.

33. The bow shoe of claim 32 wherein said suspension system further comprises a shin-level bow spring assembly comprising a bow spring pivotly attached to said one or more ankle-pivot housing, a bow guide pivotly attached to said one or more ankle-pivot housing and to the top of said bow spring, wherein said bow guide changes length telescopically, a shin slider slidingly attached to the top of said bow guide, and a shin strap for attaching said shin slider to the shin of said runner, wherein said cords extend to connect to the top of said bow spring, wherein the impact force of said runner's foot on said upper frame loads said bow spring via said cords.

34. The bow shoe of claim 32 wherein said suspension system further comprises a thigh-level bow spring assembly comprising an inside shift-to-side pulley attached to the inside one of said one or more ankle-pivot housings, an outside shift-to-side pulley attached to the outside one of said one or more ankle-pivot housings, a shin tube pivotly attached to the outside one of said ankle-pivot housings, wherein the outside ones of said cords pass directly through the outside said ankle-housing and the inside ones of said cords pass around said inside shift-to-side pulley and then around said outside shift-to-side pulley, wherein all said cords then pass up though said shin tube, a side knee pivot housed by a knee-pivot housing rigidly attached to the top of said shin tube, a hyper-extension stop preventing said side knee pivot from hyper-extending, a bow spring pivotly attached to the top of said shin tube, a bow guide pivotly attached to said shin tube via said side knee pivot and to the top of said bow spring, wherein said bow guide changes length telescopically, and a thigh strap for attaching the top of said bow spring to the thigh of said runner, wherein said cords extend through said side knee pivot to connect to the top of said bow spring, a second cord guide to constrain said cords to the location of said side knee pivot, wherein the impact force of said runner's foot on said upper frame loads said bow spring via said cords.

35. The bow shoe of claim 34 wherein said side knee pivot further comprises a straightening means to ensure that said shin tube is aligned with said bow guide at heel-strike.

36. Tile bow shoe of claim 34 wherein said straightening means comprises simple knee-joint straightener further comprising a first spring post fixedly attached to said knee-pivot housing and located on the front side of said side knee pivot, a second spring post fixedly attached to said shin tube and located on the front side of said side knee pivot, and a straightening spring connecting said first and second posts, wherein said straightening spring bias said shin tube to align with said bow guide.

37. The bow shoe of claim 34 wherein said straightening means comprises a robust straightener comprising a closer cord, a cord-path system which routes said closer cord through a path along both the back side and the front side of said shin tube and bow guide about said side knee pivot, wherein said closer cord is fixed at a first end to said bow guide, wherein the cord-path length on the back side of said side knee pivot increases more rapidly than the cord-path length on the front side of said side knee pivot as said shin tube unfolds to align with said bow guide, a closing spring located on the front side of said bow guide so as to align said bow guide with said shin tube when engaged, a spring release connected to said bow guide and to a second end of said closer cord, and a pawl system, wherein the configuration of said cord-path system causes said closer cord to pull taut at a particular flexion angle, of said bow guide with respect to said shin tube, as said suspension system extends during swing phase—causing said closer cord to pull against said closing spring accelerating this extension, wherein said spring release is triggered to release said closing spring from acting against said closer cord as just as full extension of said suspension system occurs, thereby allowing easy and force-free folding of said bow guide with respect to said shin tube at toe-off, and a reset spring for re-engaging said closer cord with said closing spring during swing phase when said closer cord becomes slack, wherein said robust straightener is keyed to said flexion angle for guaranteed alignment using said closing spring, and it is keyed to full alignment for guaranteed release of said closing spring as folding begins.

38. The bow shoe of claim 34 wherein said straightening means comprises a low-eccentricity knee-joint straightener comprising a shin tube extension extending above said side knee pivot from said shin tube, a circle tube rigidly attached to said knee-pivot housing, a slide ring slidingly attached to said circle, a circle spring connecting said slide ring to the upper end of said circle tube and confined to said circle spring, a close spring connecting said slide ring to said shin tube, wherein as said shin tube descends beyond a chosen flexion angle to straighten, said low-eccentricity knee-joint straightener acts to accelerate this straightening via said close spring with a force that increases proportional to the eccentricity of the force of said close spring about said side knee pivot, wherein when said shin tube folds beyond said chosen flexion angle said shin tube extension pushes said slide ring around said circle tube to maintain said eccentricity at a near-zero value and to maintain the torque of said close spring to resist further said folding to a very small value exerted by said circle spring.

39. The space shoe of claim 1 wherein said lower frame comprises a back-heel which is a rigid, upwardly curving extension of said lower frame, wherein the deceleration of the runner's center of mass at heel strike is reduced by decreasing the effective angle of the line of force between the runner's center of mass and the initial point of contacts of said back-heel with the ground.

40. The space shoe of claim 4 wherein said spring system comprises a delayed heel-lifter further comprising a heel-lifter spring such as a bow and a delay mechanism, wherein said delay mechanism delays the return of impact energy stored in said heel-lifter bow to be returned in the latter part of toe-thrust, thereby assisting the action of the calf muscle of said runner.

* * * * *

UNITED STATES PATENT AND TRADEMARK OFFICE

CERTIFICATE OF CORRECTION

PATENT NO. : 6,684,531 B2
DATED : February 3, 2004
INVENTOR(S) : Brian G. Rennex It is certified that error appears in the above-identified patent and that said Letters Patent is hereby corrected as shown below:

Title page,
Item [75], Inventor, the correct address for "Brian G. Rennex" is -- 306 Cedar Lane, Rockville, MD 20851 --

Signed and Sealed this

Fourth Day of May, 2004

JON W. DUDAS
*Acting Director of the United States Patent and Trademark Office*